US006828909B2

(12) United States Patent
Script et al.

(10) Patent No.: US 6,828,909 B2
(45) Date of Patent: Dec. 7, 2004

(54) PORTABLE MOTION DETECTOR AND ALARM SYSTEM AND METHOD

(75) Inventors: Michael H. Script, Buffalo, NY (US); Henry J. Script, Buffalo, NY (US)

(73) Assignee: Guardit Technologies LLC, Buffalo, NY (US)

( * ) Notice: Subject to any disclaimer, the term of this patent is extended or adjusted under 35 U.S.C. 154(b) by 94 days.

(21) Appl. No.: 10/119,535

(22) Filed: Apr. 8, 2002

(65) Prior Publication Data

US 2003/0020611 A1 Jan. 30, 2003

Related U.S. Application Data

(63) Continuation-in-part of application No. 09/785,702, filed on Feb. 16, 2001, now Pat. No. 6,542,078, which is a continuation-in-part of application No. 09/271,511, filed on Mar. 18, 1999, now Pat. No. 6,215,396, which is a continuation-in-part of application No. 08/865,886, filed on May 30, 1997, now abandoned.

(60) Provisional application No. 60/018,829, filed on May 30, 1996.

(51) Int. Cl.[7] ..... G08B 13/08

(52) U.S. Cl. ..... 340/545.1; 340/5.8; 340/539.1; 340/546; 340/547; 340/548

(58) Field of Search ..... 340/531, 533, 340/539.1, 545.1, 546, 547, 548, 568.1, 572.1, 573.1, 524, 525, 541, 5.1, 5.8; 379/37–44; 348/143, 152, 153, 154, 155, 159, 169

(56) References Cited

U.S. PATENT DOCUMENTS

| | | | | | |
|---|---|---|---|---|---|
| 3,696,359 | A | | 10/1972 | Ross et al. | 340/547 X |
| 3,696,380 | A | | 10/1972 | Murphy | 340/546 |
| 3,781,836 | A | | 12/1973 | Kruper et al. | 340/539 |
| 3,833,895 | A | | 9/1974 | Fecteau | 340/545.1 X |
| 3,925,763 | A | * | 12/1975 | Wadhwani et al. | 340/545.1 |
| 4,148,019 | A | | 4/1979 | Durkee | 340/545.1 X |
| 4,149,156 | A | | 4/1979 | Blasucci | 340/545.2 |
| 4,271,405 | A | | 6/1981 | Kitterman | 340/512 |
| 4,335,379 | A | * | 6/1982 | Martin | 340/692 |
| 4,446,454 | A | | 5/1984 | Pyle | 340/538 |
| 4,511,886 | A | | 4/1985 | Rodriguez | 340/534 |
| 4,737,770 | A | | 4/1988 | Bunius et al. | 340/539 |
| 4,888,580 | A | | 12/1989 | Distel | 340/573.1 |
| 5,317,303 | A | | 5/1994 | Ross et al. | 340/539 |
| 5,319,698 | A | | 6/1994 | Glidewell et al. | 379/39 |
| 5,489,890 | A | | 2/1996 | Moser | 340/546 |
| 5,850,180 | A | | 12/1998 | Hess | 340/541 |
| 6,052,052 | A | | 4/2000 | Delmonaco | 340/539 |
| 6,150,936 | A | * | 11/2000 | Addy | 340/539.2 |
| 6,163,257 | A | | 12/2000 | Tracy | 340/506 |
| 6,215,396 | B1 | | 4/2001 | Script | 340/545.1 |
| 6,661,340 | B1 | * | 12/2003 | Saylor et al. | 340/541 |
| 2003/0078029 | A1 | * | 4/2003 | Petite | 455/404 |

* cited by examiner

*Primary Examiner*—Thomas J Mullen, Jr.
(74) *Attorney, Agent, or Firm*—Walter W. Duft

(57) ABSTRACT

A portable security alarm system which can be installed on a temporary basis and removed from an object whose movement is to be detected including a motion detecting and radio signal transmitting member for mounting proximate the object whose movement is to be detected, a member for selectively coupling and decoupling the motion detecting and radio signal transmitting member relative to the object whose movement is to be detected, a combined radio signal receiving and alarm generating member for receiving a signal from the combined motion detecting and radio signal transmitting member and producing an alarm, a remote control for actuating and deactuating the radio signal receiving and alarm generating member, and components for providing object identification information identifying the object whose movement is to be detected and distance measurement information for measuring the distance moved by the object.

30 Claims, 16 Drawing Sheets

PORTABLE MOTION DETECTOR AND ALARM SYSTEM AND METHOD

CROSS-REFERENCE TO RELATED APPLICATIONS

This application is based on provisional application Ser. No. 60/018,829, filed May 30, 1996 in the name of the same inventor, and it is a continuation-in-part of application Ser. No. 09/785,702, filed Feb. 16, 2001 (now U.S. Pat. No. 6,542,078), which is a continuation-in-part of application Ser. No. 09/271,511, filed Mar. 18, 1999 (now U.S. Pat. No. 6,215,396), which is a continuation-in-part of application Ser. No. 08/865,886, filed May 30, 1997 (Abandoned).

BACKGROUND OF THE INVENTION

1. Field of the Invention

The invention relates generally to an improved motion detector and alarm system for actuating an alarm device in response to movement of an object, and more particularly to a portable motion detector and alarm system which is easy to install and operate and is capable of detecting motion relative to a variety of predetermined positions.

2. Prior Art

The problem of protecting homes, businesses and other premises against unauthorized intrusions is becoming increasingly important due to the increase in vandalism, theft and even physical attacks upon the inhabitants. Various prior art systems have been developed to address the problem and numerous examples exist of alarm or warning devices. One commonly used protective system involves wiring doors and windows in such a manner that an unauthorized opening of the door or window activates an electric circuit which in turn produces an alarm.

For example, U.S. Pat. No. 4,271,405 to Kitterman discloses an alarm control system for protecting a premises including a four conductor bus line leading from a master control station and extending about the interior perimeter of the premises. Sensors positioned near each port of entry to be monitored are connected in parallel relationship to the bus line. Each sensor carries a biased reel carrying line secured to a window, door, screen or the like. Disturbance of a sensor causes a magnetically responsive switch therein to generate a pulse triggering circuitry within the control station to activate the desired alarm device.

While effective, this system requires extensive wiring of the premises as a bus line must be routed about the interior perimeter of the premises between a master control station and the ports of entry at which the motion sensors are to be located. Hence, this system is time consuming and complicated to install, and installation may require expertise beyond that of the average home or business owner. Once installed, the sensors of this system are not easily relocated. Further, the system may be defeated by cutting the wires extending between the sensors and the master control station.

U.S. Pat. No. 3,781,836 to Kruper et al discloses an alarm system including a magnetic pulse generator for producing an output pulse in response to a change in magnetic flux in response to an intrusion of a designated area. A radio transmitter circuit responds to the pulse from the magnetic pulse generator by transmitting a signal to a remote receiver circuit which in turn generates a pulse for actuating an intrusion alarm circuit. The system requires a complex linkage assembly to translate motion of the object to motion of a magnet. In addition a relatively bulky pick-up coil assembly is necessary to generate the pulse to be applied to the transmitter circuit.

U.S. Pat. No. 3,696,380 to Murphy discloses a portable alarm device with a battery or low voltage operated sound signal triggered by a magnetic reed switch which is closed to complete the circuit by a magnet attached to a movably mounted arm, the poles of the magnet being positioned perpendicular to the longitudinal dimension of the contact strips of the reed switch to cause the reed switch to close when the magnet is in either of two positions relative to the switch.

A need remains for a motion detection and signal generating system which is small in size, easily transportable, easy to install and which can sense motion relative to any desired initial position of an object. An additional desirable capability of the foregoing system would be to provide information about the detected motion to the owner of the object, or a remote location such as a law enforcement or other security agency It would likewise be desirable to provide identification information about a specific object whose motion has been detected in the event that the motion detection and signal generating system is implemented to detect motion at multiple locations (e.g., doors, windows) within a larger security area (e.g., a residence, an office or otherwise).

BRIEF SUMMARY OF THE INVENTION

Accordingly, it is a principal object of the invention to provide a system for detecting the movement of an object comprising: an object whose movement is to be detected, movable magnet means coupled to the object such that movement of the object results in movement of said movable magnet means, and means for detecting movement of the movable magnet means and providing an indication of the movement. The means for detecting is in communication with the movable magnet means.

The system further includes radiating means for wirelessly transmitting a predetermined signal in response to the indication of movement, the radiating means being coupled to the means for detecting. The object whose movement is to be detected may be coupled to the movable magnet means by a wire means which can also serve as the radiating means.

The system further includes means for receiving the predetermined signal, the means for receiving being separate from and located at a distance from the radiating means. The system preferably includes means for generating an alarm signal when the predetermined signal is received by the means for receiving. The alarm signal thus generated may be audible, visual or electronic and may include speakers, warning horns, lamps and the like.

It is a further object of the invention to provide a method of detecting movement of one or more objects comprising the steps of: a) coupling each object whose movement is to be detected to a corresponding movable magnet such that movement of any object results in movement of the corresponding magnet; b) detecting the motion of the corresponding magnet; c) transmitting a predetermined signal in response to the detected motion, and, d) receiving the predetermined signal at a distance from the object, or objects, whose motion is to be detected.

The method may include the further step of providing an alarm signal when the predetermined signal is received by the receiver means. The alarm signal may be audible, visible, or may be an electronic alarm signal which is transmitted to a remote alarm center via a telecommunications means such as a telephone line.

It is a further object of the invention to provide a movement detection and alarm system which may be affixed to a wide variety of objects including inside doors, outside gates, garage doors, children's barriers such as "baby gates", valuable wall hangings and paintings, and countless other objects.

It is a further object of the invention to provide a movement detection and alarm system which is portable and is easily packed in a suitcase and transported with a traveler to be later installed on motel or hotel room doors, windows and/or any objects within the room, whenever additional protection is desired by the traveler.

It is a further object of the invention to provide a movement detection and alarm system that provides movement information to a remote location, such as a law enforcement or security agency.

It is a further object of the invention to provide a movement detection and alarm system wherein the movement information includes an indication of the distance that is moved for measuring purposes.

It is a further object of the invention to provide a movement detection and alarm system that provides object identification information either locally at or near the site of the object or remotely to a designated location such as a telephone number, email address, etc.

It is a further object of the invention to provide a movement detection and alarm system wherein the object identification information is locally or remotely programmable.

It is a further object of the invention to provide a movement detection and alarm system wherein the movable magnet means and the radiating means are part of a remotely controllable trigger unit having both a radio transmitter and a radio receiver.

The present invention relates to a portable security alarm system which can be installed on a temporary basis and removed from an object whose movement is to be detected comprising a motion detecting and radio signal transmitting member, means for selectively coupling and decoupling said motion detecting and radio signal transmitting member relative to said object whose movement is to be detected, and a combined radio signal receiving and alarm generating member for receiving a signal from said combined motion detecting and radio signal transmitting member and producing an alarm. The alarm system also preferably includes a remote control member for selectively actuating and deactuating said combined radio signal receiving and alarm generating member. The alarm system also preferably includes an information gathering device for gathering movement information and a remote notification device for providing the movement information to a remote location. As an optional feature, the alarm system can be implemented such that the signal from the combined motion detecting and radio signal transmitting member includes an identification code that is used to provide object identification information either locally or to a remote location. Local or remote programmable means can be provided for selectively associating the object identification information with the identification code. As an additional optional feature, the combined motion detecting and radio signal transmitting member can be adapted to provide distance information representing a distance moved by an object whose movement is to be detected. The combined motion detecting and radio signal transmitting member can also include radio signal receiving means and control logic means to facilitate remote control of the device for polling or programming purposes.

BRIEF DESCRIPTION OF THE SEVERAL VIEWS OF THE DRAWING

The foregoing and other objects and features of the present invention will become more fully apparent from the following description and appended claims, taken in conjunction with the accompanying drawings. Understanding that these drawings depict only typical embodiments of the invention and are, therefore not to be considered limiting of its scope, the invention will be described with additional specificity and detail through use of the accompanying drawings in which:

DETAILED DESCRIPTION OF THE INVENTION

The following detailed description of the embodiments of the present invention, as represented in FIGS. 1–10, is not intended to limit the scope of the invention, as claimed, but is merely representative of the presently preferred embodiments of the invention. The presently preferred embodiments of the invention will be best understood by reference to the drawings, wherein like parts are designated by like numerals throughout.

Figure 1:
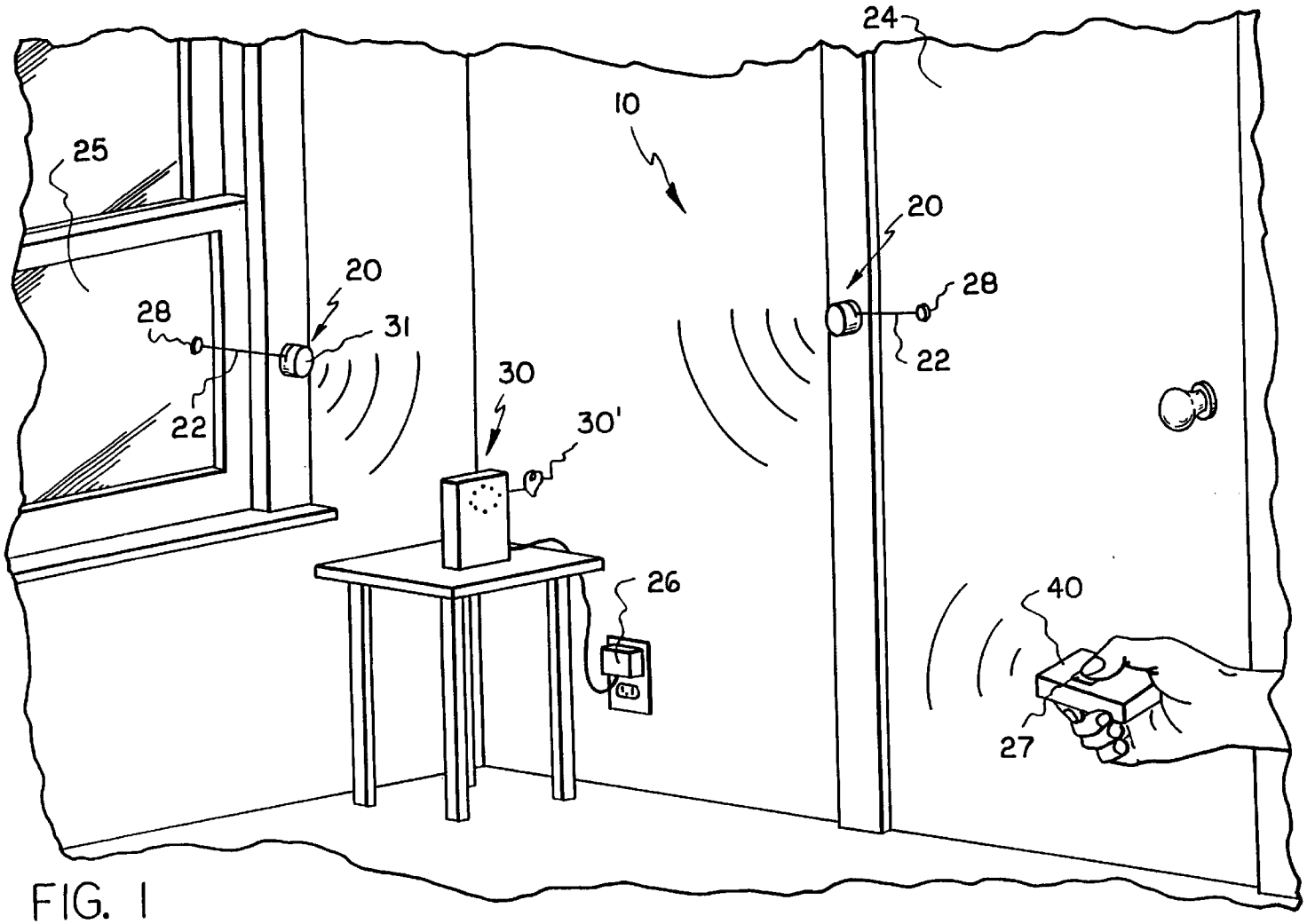
FIG. 1 is a pictorial diagram showing the components of the system according to the present invention as they appear in use.

FIG. 1 shows, in pictorial block diagram form, the major components of the movement detecting device and alarm system 10 of the present invention. The system is comprised of at least one movement detecting and signal transmitting means 20, including a retractable wire means 22, a receiver means 30 and a remote control means 40.

More than one movement detecting and signal transmitting means 20 may be utilized in implementing the system of the present invention. One movement detecting and signal transmitting means 20 may be placed on each object whose movement it is desired to detect. For example, in a room with four windows 25 and two doors 24, six movement detecting and signal transmitting means 20 may be utilized, one on each window and one on each door. However, only one receiver means 30 is necessary regardless of the number of movement detecting and signal transmitting means 20 used. There is no limit to the number of movement detecting and signal transmitting means 20 which may be used with one receiver.

Each movement detecting and signal transmitting means 20 is coupled to one object, such as a door 24, or window 25, whose movement is to be detected. In a preferred embodiment, the coupling means is a retractable wire 22 which extends from movement detecting and signal transmitting means 20 to the object, 25 or 24, whose movement is to be detected. One end of retractable wire 22 is affixed to the object and the other is coupled to movable magnets (best illustrated in FIGS. 4, 5 and 6) located inside casing 31 of movement detecting and signal transmitting means 20. Typical means of affixing the end of retractable wire 22 to an object include VELCRO tabs, glue, removable tape, and the like.

Receiver means 30 is configured to receive a predetermined signal which is wirelessly transmitted by movement detecting and signal transmitting means 20 whenever the object whose movement is to be detected, is displaced from a predetermined position. The object whose movement is to be detected need not be in any particular position when the end of retractable wire 22 is affixed thereto. If the object is a window, such as depicted at 25, the window may be closed, or it may be partially or fully open, when retractable wire 22 is affixed. Any displacement from its position when retractable wire 22 is affixed will be detected and alarmed.

Accordingly, a window may be left in a partially open position, as for example, to provide fresh air to a room, while the occupant attends to other matters, or sleeps. Any displacement from the partially open position will cause the alarm signal to be generated. Even in a situation wherein an intruder reached into the window and removed movement detecting and signal transmitting means 20 from the window, the predetermined signal would be transmitted and the alarm signal generated, thus warning the occupant of an intrusion.

Receiver means 30 can be any receiver known in the art capable of receiving the signal transmitted through retractable wire 22. In response to the transmitted signal, receiver means 30 initiates a local alarm which can be audible or visual. In addition, receiver means 30 may initiate contact with police, medical, rescue or other emergency facilities or agencies. Receiver means 30 can be AC powered and may be equipped with an on/off switch. Receiver means 30 need not be co-located with movement detection and signal transmitting means 20 and can be positioned anywhere within reception distance of the transmitted signal. Receiver means 30 may be positioned anywhere about the room or the area to be protected and may be placed up to a distance of 150 ft. to 200 ft. or greater from movement detecting and signal transmitting means 20.

In a preferred embodiment receiver means 30 is powered by alternating current (AC). Therefore, it must be located such that a power cord, or an extension thereof, can be extended to the nearest AC outlet. Alternate embodiments of receiver means 30 may be powered by battery, or may include battery backup means to supply power to receiver means 30 in the event of a power failure.

Figure 10:
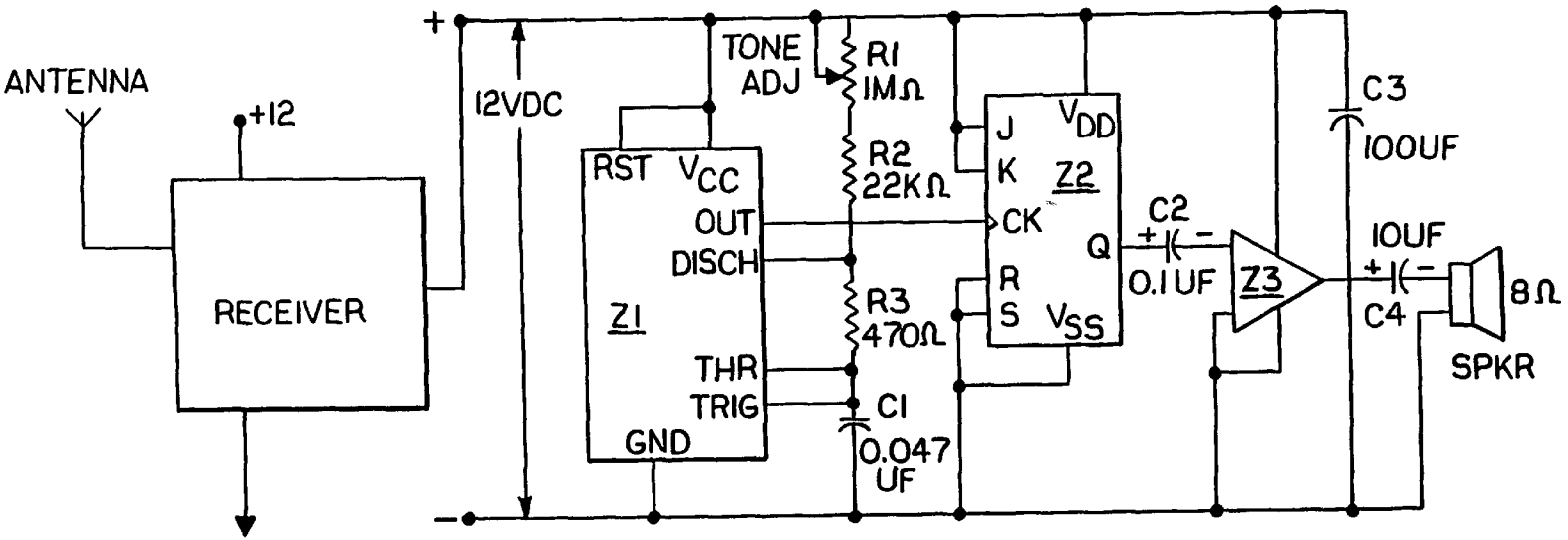
FIG. 10 is a schematic diagram of one embodiment of a receiver means according to the present invention.

In a preferred embodiment, receiver means 30 is a commercially available BLACK WIDOW receiver unit, or similar units, which may be purchased off-the-shelf from various electronics supply companies such as Whitney Electronics or Holsfelt Electronics. An AC adapter such as that depicted at 26 in FIG. 1 may be used to provide the correct operating voltage for receiver means 30. In a preferred embodiment of the present invention a BLACK WIDOW RF receiver Model #2. CL manufactured by LCD Co. of California was used as a receiver. FIG. 10 shows a schematic diagram, of a type well understood by those of ordinary skill in the electronics arts, of a receiver unit suitable for use in the present invention.

Returning to FIG. 1, the system of the present invention may also include a remote control unit 40 which may be purchased from the same source as receiver means 30. Remote control means 40 controls the operating state of receiver means 30. That is, remote control means 40 may be used to electronically enable or disable receiver means 30 such that the response of receiver means 30 to the signal transmitted by retractable wire 22 can be controlled. Remote control means 40 preferably includes a panic button which, when depressed or otherwise enabled, transmits a signal which instantly activates the alarm function of receiver means 30. The means for activating can be a switch 27 which may be operated by hand to cause remote control unit 40 to activate the alarm signal, or to discontinue the alarm signal after it has been activated by either the predetermined signal or the remove control unit 40 itself.

This feature serves as a "panic" button, i.e., a means of triggering the alarm within receiver means 30 to attract attention or call for aid in the presence of other emergencies. When it is desired to discontinue the alarm signal, switch 27 may be set to a position which causes the previously activated alarm signal to stop. Such remote control units and receivers are well known in the electronic arts and are commonly used in other electronics applications. Accordingly, remote control unit 40 is also readily available from commercial sources and may be purchased and utilized in the system of the present invention "off-the-shelf." The transmitter circuit of remote control unit 40 may be used as a model for transmitter 4 (FIG. 9) of the movement detector and signal transmitting means 20 of the present invention such that both transmit the proper signal for receiver means 30.

This feature may also serve as a means of testing the system 10 to determine its operational status, i.e., ready to operate (or armed), or malfunctioning. If switch 27 is manually set by the operator to a position designed to activate the alarm signal within receiver means 30, and no alarm signal is produced, a malfunction condition is present. If the alarm signal within receiver means 30 is produced, the system 10 may be considered "armed" or ready to operate.

Once system 10 is configured as desired, i.e., each movement detecting and signal transmitting means 20 is positioned on a corresponding object whose motion is to be detected, and receiver means 30 is armed, any movement of window 25 or door 24 will cause a predetermined signal to be radiated from movement detecting and signal transmitting means 20 and wirelessly transmitted to receiver means 30. Receiver means 30 will receive the transmitted predetermined signal and provide an alarm signal in response. In the embodiment shown the alarm signal is an audio signal provided through one or more speakers located within receiver means 30.

Figure 2:
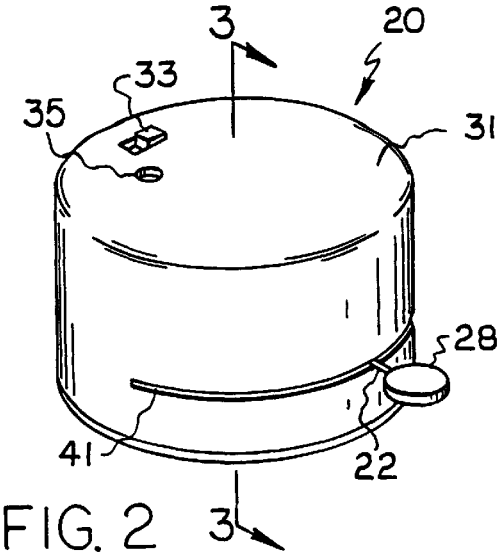
FIG. 2 is a perspective view of the motion sensing and transmitting means of the present invention.

Turning now to FIG. 2 there is shown a perspective view of movement detecting and signal transmitting means 20, including casing 31, switch 33, retractable wire affixing means 28 and retractable wire 22. Casing 31 may include an opening 35 for allowing visible light, as from a lamp or an LED 32, to be seen by the naked eye. The illumination of such a lamp, or light emitting means, gives an operator a visible indication of the operational status of movement detecting and signal transmitting means 20.

Casing 31 further includes a slotted opening 41 through which retractable wire 22 and retractable wire affixing means 28 may be disposed. This allows flexibility in positioning retractable wire 22 on an object relative to the position of movement detecting and signal transmitting means 20.

Figure 3:
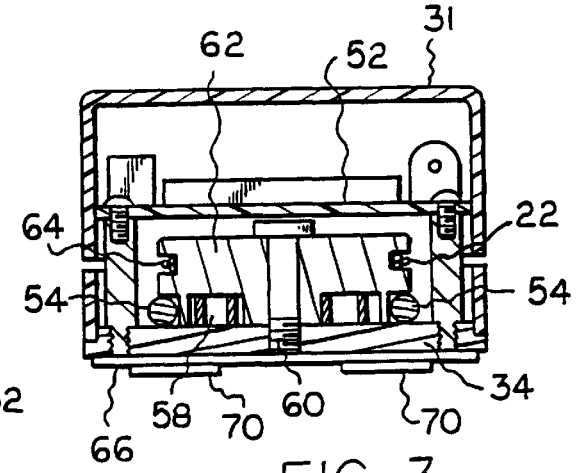
FIG. 3 is a cross sectional view of the motion sensing and transmitting means of the present invention taken along lines 3—3 of FIG. 2.

FIG. 3 shows a cross sectional view of the movement detecting and signal transmitting means depicted in FIG. 2, taken along lines 3—3 of FIG. 2. Casing 31 surrounds the internal components. The major internal components of movement detecting and signal transmitting means 20 are: an electronic circuit board 52, a rotatable frame 62 for supporting magnet means 54, a supporting base means 34 and a rear panel 66. Rotatable frame 62 includes a channel means 64, wherein retractable wire means 22 may be disposed, and wrapped around rotatable frame 62. Also shown is spring means 58 (best illustrated in FIG. 8) for maintaining constant tension on wire means 22 as wire means 22 is pulled closer, or further from casing 31. The foregoing components are coupled together by pin means 60 (best illustrated in FIGS. 7 and 8).

Figure 4:
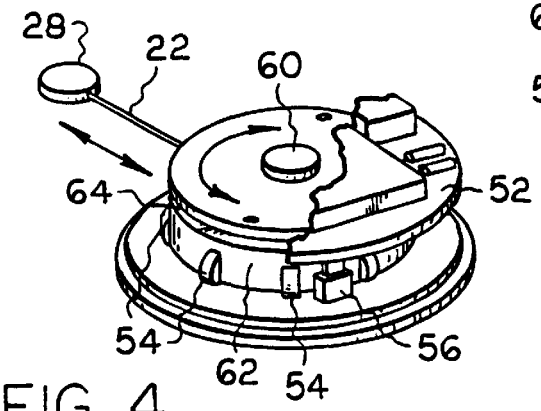
FIG. 4 is a perspective view of the interior of the motion sensing and transmitting means of the present invention.

As shown in FIG. 4 retractable wire means 22 is in communication at one end with rotatable frame 62. Rotatable frame 62 includes one or more movable magnets 54, preferably opposite pole magnets which are spaced from each other and disposed within rotatable frame 62. The preferred embodiment includes 8 such magnet means 54 spaced equidistantly from each other around rotatable frame 62. Magnet means 54 may be of a type commonly available commercially from sources such as Radio Shack. One such magnet means suitable for use in a preferred embodiment of the present invention is a common ⅛" diameter earth magnet available from Radio Shack, part number 64-1895.

Rotatable frame 62 is preferably a circular supporting frame which is provided with a central opening 70 about which rotatable frame 62 rotates. Rotatable frame 62 is adapted to include a channel 64 for receiving retractable wire 22. Channel 64 extends about the circumference of rotatable frame 62 and allows retractable wire 22 to be wrapped about rotatable frame 62 in a manner similar to that of a string wrapped around a yo yo. The end of retractable wire 22 is in contact with rotatable frame 62 may be affixed to rotatable frame 62 by traditional means such by knotting the end of retractable wire 22 and inserting it into a notch within channel 64, or by wrapping and tying one end of retractable wire 22 securely around channel 64. Retractable wire 22 must be secured such that slippage of retractable wire 22 within channel 64 is avoided. Other means of securing one end of retractable wire 22 within channel 64 will be readily apparent to those skilled in the art.

Magnet means 54 may be inserted into openings (not shown) in rotatable frame 62 and held in place by means of glue, or other suitable affixing means. The openings into which magnet means 54 are inserted should provide a snug fit for magnet means 54 such that movable magnet means 54 will remain securely in place throughout the life of system 10.

Figure 7:
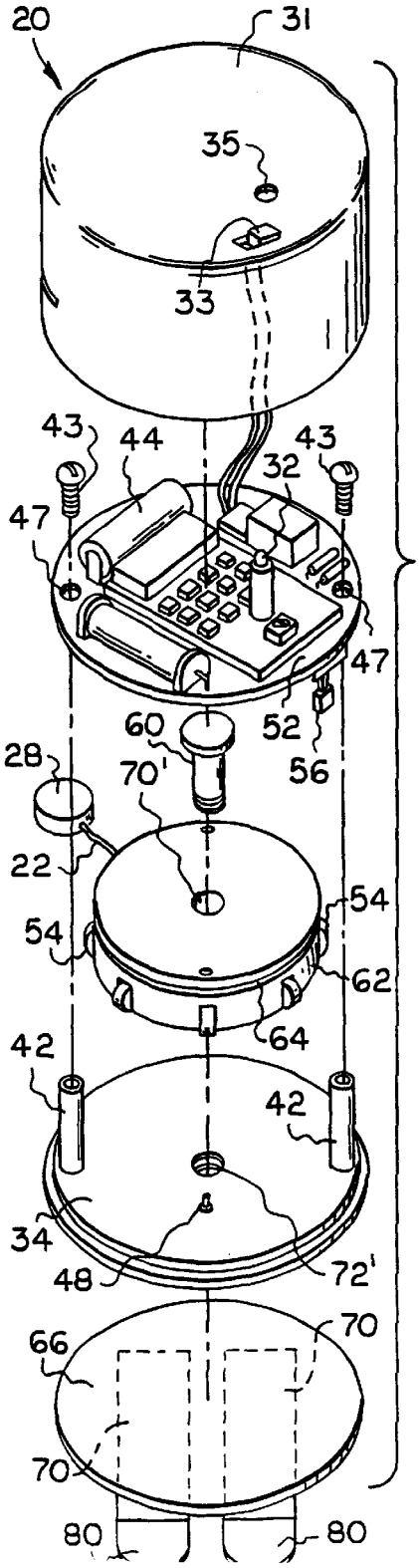
FIG. 7 is an exploded top perspective view of the motion sensing and transmitting means of the present invention.
Figure 8:
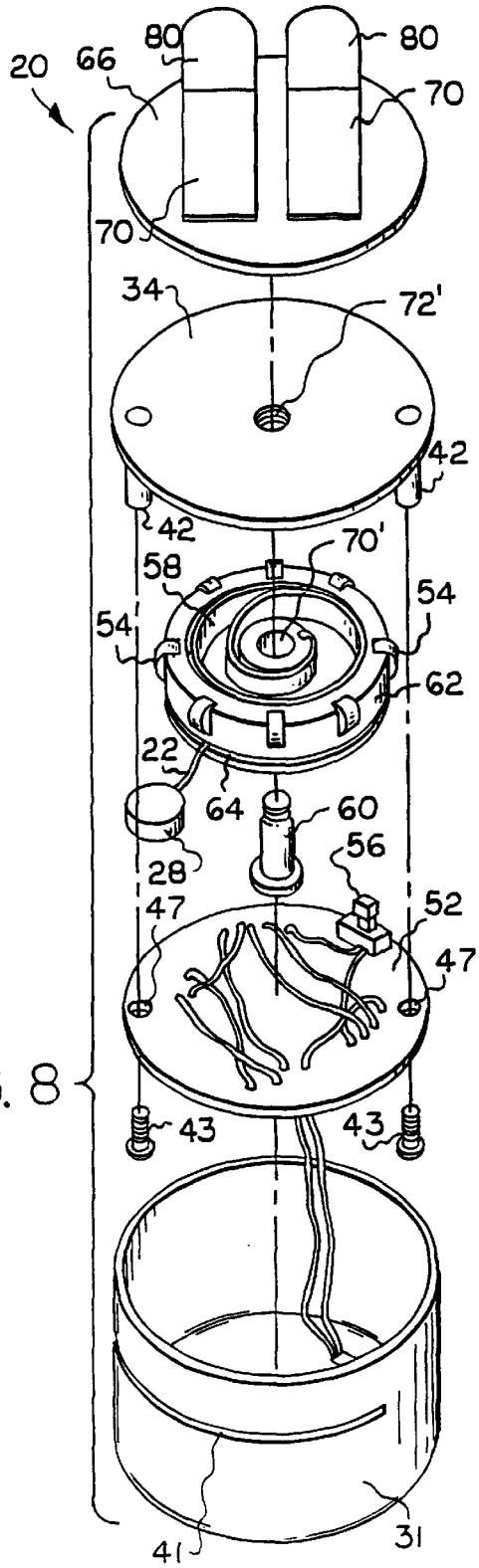
FIG. 8 is an exploded bottom perspective view of the motion sensing and transmitting means of the present invention.

FIGS. 7 and 8 show exploded views from the top and bottom, respectively, of movement detecting and signal transmitting means 20. As shown in the figures, case 31 and rear panel 66 enclose the components of movement detecting and signal transmitting means 20. On/off switch 33 provides a means for connecting and disconnecting power from battery 44 from the components residing on electronic circuit board 52. Battery 44 may be a common 9V battery of a size suitable for disposition within case 31. Other battery means, such as miniature batteries, may be utilized to construct smaller embodiments of the present invention. Such means will be readily apparent to those skilled in the art.

Electronic circuit board 52 includes means 56 for detecting movement of movable magnet means 54. Means 56 for detecting movement of movable magnet means 54 may be a magnetic field sensor such as a KMZ10B available from Phillips Semiconductors. A schematic diagram of a type readily understood by those skilled in the electronics arts illustrating a preferred circuit connection for means 56 for detecting movement, is provided in FIG. 9.

The circuit depicted in FIG. 9 operates generally as follows. When the object whose movement is to be detected moves in any direction, retractable wire 22 either extends or retracts (as best depicted in FIG. 1). When the object moves toward movement detecting and signal transmitting means 20, retractable wire 22 recoils toward movement detecting and signal transmitting means 20, and vice versa.

Figure 6:
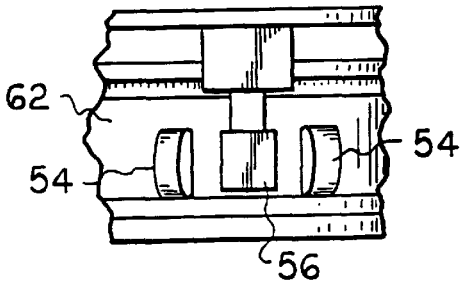
FIG. 6 is a close-up view of the movable magnet means.
Figure 5:
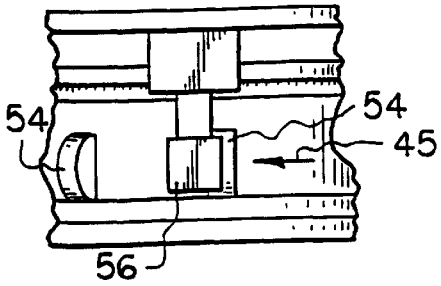
FIG. 5 is a close-up view of the sensing means.

As retractable wire 22 moves, movable magnets 54 rotate. When movable magnet means 54 are displaced from their resting position, a change in the magnetic field surrounding movable magnet means 54, with respect to magnetic field sensor 56 occurs. FIG. 6 shows two rotatable magnet means 54 in one possible resting position with respect to magnetic field sensor 56. FIG. 5 shows movable magnet means 54 as they move in direction 45, as shown by the arrow, past magnetic field sensor 56. It is the change of the position of movable magnets relative to magnetic field sensor 56 which is detected by magnetic field sensor 56.

Returning to FIG. 9, magnetic field sensor 56 senses the change in the magnetic field and provides a signal representing the change, to comparator 1, in this case a common LM 741. The output of comparator 1 causes relay 2 to energize closing contact 3 and enabling battery power to operate radiating means, i.e., transmitter 4. The circuitry of transmitter 4 can be any available transmitter configuration known in the art which is capable of transmitting a signal through retractable wire 22 and which can be configured to fit on transmitter circuit board 52.

Transmitter 4 generates a predetermined signal which is in turn radiated and wirelessly transmitted to receiver means 30. In a preferred embodiment, the output of transmitter 4 is coupled to wire means 22, which serves as a transmit antenna. Retractable wire 22 can be a suitable length of wire, cable, or any other electrically conductive material.

Figure 9:
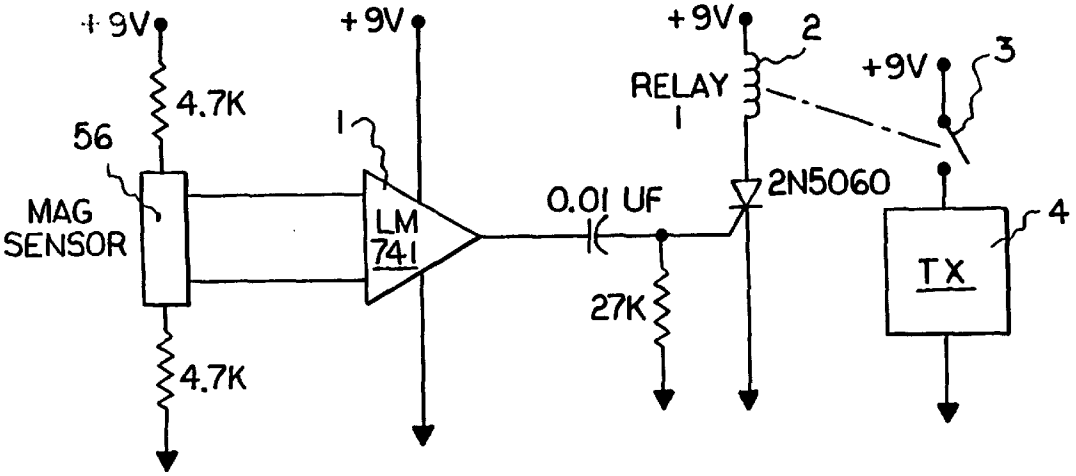
FIG. 9 is a schematic diagram of one embodiment of a transmitting means according to the present invention.

As will be readily appreciated by those skilled in the art, electronic circuit board 52, as embodied in the circuit diagram circuit of FIG. 9 has many equivalents. It is not intended that the invention be limited to the particular circuit depicted in FIG. 9.

Returning now to FIGS. 7 and 8 electronic circuit board 52 may also include a lamp 32 which illustrates when switch 33 is turned to the "on" position and power from battery 44 is applied to the electronic components residing on circuit board 52. Electronic circuit board 52 is adapted to include openings 47 through which fastening means 43, which may be conventional screws, are passed as shown.

Rotatable frame 62, including retractable wire channel 64 and magnet means 54 is located beneath electronic circuit board 52. Rotatable frame 62 includes a central opening 70 through which central fastening means 60 is passed. Beneath rotatable frame 62 lies supporting base means 34 which is adapted to include a central threaded opening 72 for receiving the threaded end of central fastening means 60. Threaded nuts 42 receive fastening means 43, and act as spacers to hold rotatable frame 62 sufficiently distant from supporting base means 34 to allow rotatable frame 62 to rotate. In this manner circuit board 52, rotatable frame 62, and supporting base means 34 are coupled together such that rotatable frame 62 may rotate freely about central fastening means 60.

FIG. 8 shows spring means 58 as it appears coiled around the interior of rotatable frame 62. Spring means 58 is secured at one end to supporting base means 34 by means of pin 48. Spring means 58 is thereby positioned to maintain tension on retractable wire means 22, as rotatable frame 62 rotates. Thus spring means 58 provides the retraction mechanism for retractable wire means 22.

In accordance with the portability aspect of the present invention, the above-described structure has been modified as follows. First of all, rear panel 66 of casing 31 (FIGS. 3 and 8) has pressure-sensitive adhesive strips 70 thereon which can be pressed into firm engagement with a window sill or doorjamb (FIG. 1) and which will leave no marks when removed. Strips 70 are marketed under the trademark COMMAND of the 3M Company. The 3M COMMAND strips 70 have pressure-sensitive adhesive on both surfaces. One surface adheres to rear panel 66 and the other surface adheres to the fixed surface proximate the object whose movement is to be detected. Tabs 80 of strips 70 extend outwardly beyond panel 66 and they do not have any adhesive on their opposite sides. After the panel 66 has been adhesively secured to a surface and it is desired to demount the movement detecting and signal transmitting means 20, it is merely necessary to grasp each tab 80 and pull it away from panel 66 in the direction of the longitudinal axis of each strip and substantially parallel to the surface of panel 66. This will release the strips 70 from the surface on which member 20 is mounted and it may also release them from panel 66. Strips 70 preferably are applied to the rear panel 66 every time the member 20 is to be mounted. Any other suitable pressure-sensitive adhesive may be used. The main objective is that the mounting causes the signal transmitting means 20 be firmly mounted in a manner such that it will not move while mounted but which permits it to be removed so that it can be transported to another location.

Figure 11:
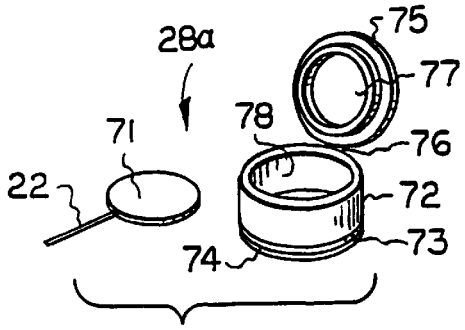
FIG. 11 is an exploded view of the structure for affixing the outer end of the retractable wire to the object whose movement is to be detected.

In accordance with the present invention, the retractable wire-affixing means 28*a* of FIG. 11 includes a disc 71 affixed to the outer end of wire 22 and an anchor member in the form of cup member 72 having pressure-sensitive adhesive 73 mounted on its underside which is covered by release paper 74. Cup member 72 also includes a cover 75 which is connected to cup member 72 by a molded hinge 76. The cover has a disc-like protrusion 77 having an outer edge which fits in tight engagement with the inner wall 78 of cup-like member 72 when the cover is in a closed position. The cup member 72 is a commercial product sold under the trademark CROWN BOLT of the Crown Bolt, Inc. company of Cerritos, Calif., except that it does not have the pressure-sensitive adhesive thereon, which has been added in accordance with the present invention. It will be appreciated that other types of anchor members can be used instead of a cup member 72. Such devices may include a small hook or post mounted on a base having pressure-sensitive adhesive thereon in an analogous manner similar to adhesive 73. Also, as an alternative, disc 28 may have a hole therein so that it is essentially a ring which may be mounted on a simple post having a base with pressure-sensitive adhesive thereon, as noted above. Also, the post may have a bulbous outer end so that it looks like a collar button. Also, if desired, the outer end of wire 22 may be formed in a loop which may be placed on a post or hook. In fact, any suitable arrangement can be used wherein a small unobtrusive member, such as the foregoing anchor members, may be securely fastened to the member whose movement is to be detected and an attachment member may be formed on the end of the wire 22 which can be removably fastened to the small unobtrusive member.

In use, the cup anchor member 72 is securely adhesively affixed to an object whose movement is to be detected, such as a window or door, as shown by wire-affixing means 28 of FIG. 1, after the release paper 74 has been removed from pressure-sensitive adhesive 73. Thereafter, while the cover 75 is in the position shown in FIG. 11, the disc 71 at the end of wire 22 is inserted into the cavity of cup 72 and the lid 75 is closed. The other types of anchor members can be used as alternates to the cup anchor member. Thus, the system is in a position to operate as described above.

When the person who has temporarily used the portable system desires to leave the place where the system has been installed and take the portable system with him, he need merely deactivate the system and thereafter open lid 75 to remove disc 71 and permit wire 22 to retract disc 71 back to a position wherein it abuts the casing 31. The cylindrical cup 72 is merely left in position on the window or door jamb, and it is substantially unobtrusive inasmuch as its overall diameter is only about ⅜" and its height is about ¼". The other types of anchor members described above may also be left where they were adhesively secured to the movable member.

As noted above, the system of the present invention can be carried in a brief case, purse or overnight case from place to place. In this respect, the total weight of a preferred embodiment is approximately 20 ounces, and it has a volume which occupies a very small portion of a brief case, suitably sized purse or a suitcase.

While the foregoing portion of the specification has designated wire 22 as being an antenna, it will be appreciated that a suitable antenna may be incorporated within housing 31 and the element 22 may be a suitable high strength string-like member made of suitable plastic or any other suitable material.

Figure 12:
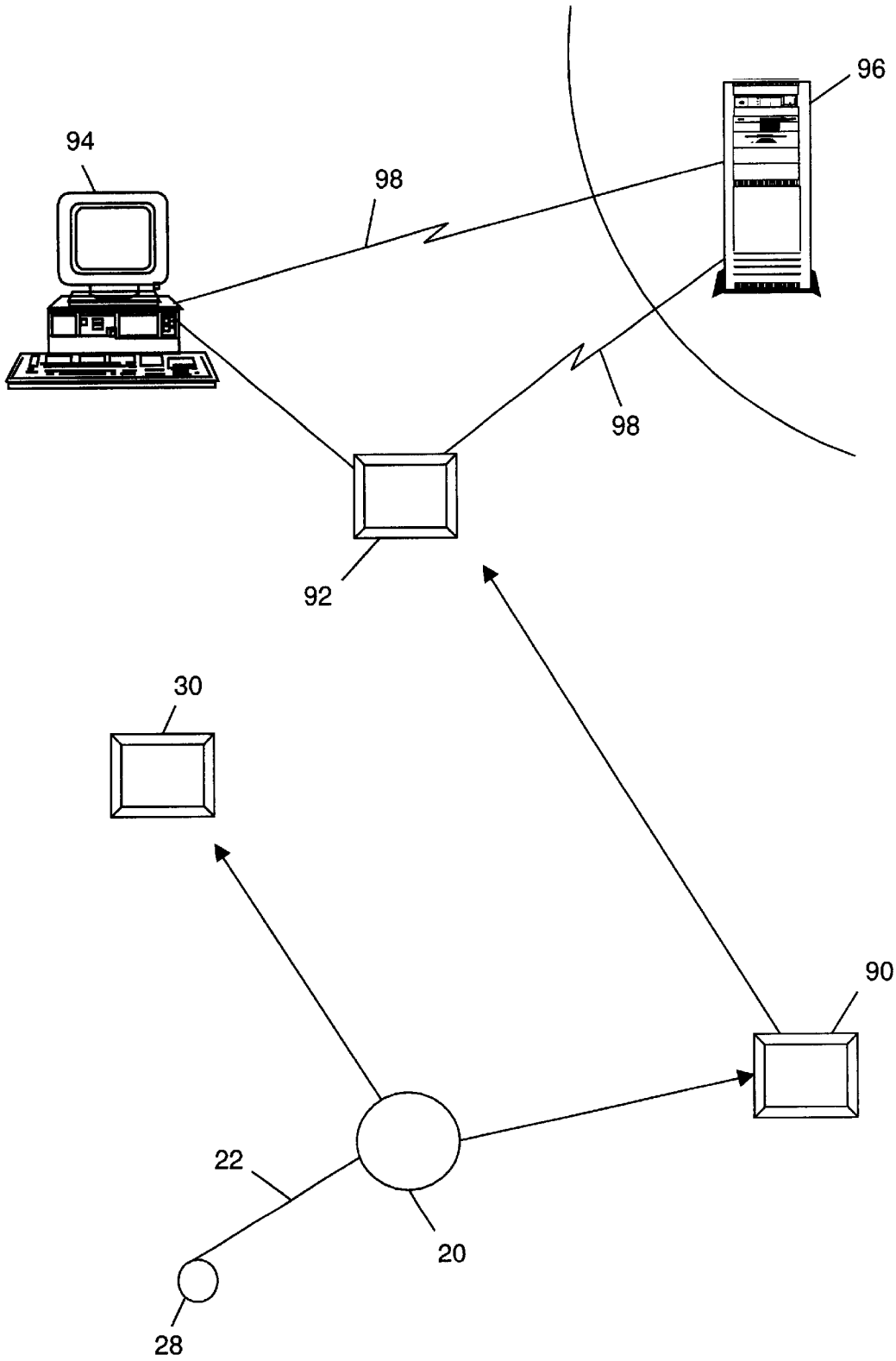
FIG. 12 is a functional block diagram showing the system of the invention including a remote notification device and an information gathering device.

Turning now to FIG. 12, an enhanced version of the movement detecting device and alarm system 10 is shown wherein motion detection information is collected in response to the detection of movement and provided to a remote facility, such as a law enforcement or security agency. FIG. 12 functionally illustrates several of the components discussed above relative to FIGS. 1–11; namely, the above-described movement detecting and signal transmitting means 20, the retractable wire 22, the retractable wire affixing means 28, and the receiver means 30. FIG. 12 further illustrates an information gathering device 90 and a remote notification device 92. Also shown is an optional computer platform 94. A remote network computer host is further represented at 96. It will be seen that the remote notification device 92 communicates with the network computer host 96, either directly or through the optional computer platform 94, via communication links 98.

Figure 13:
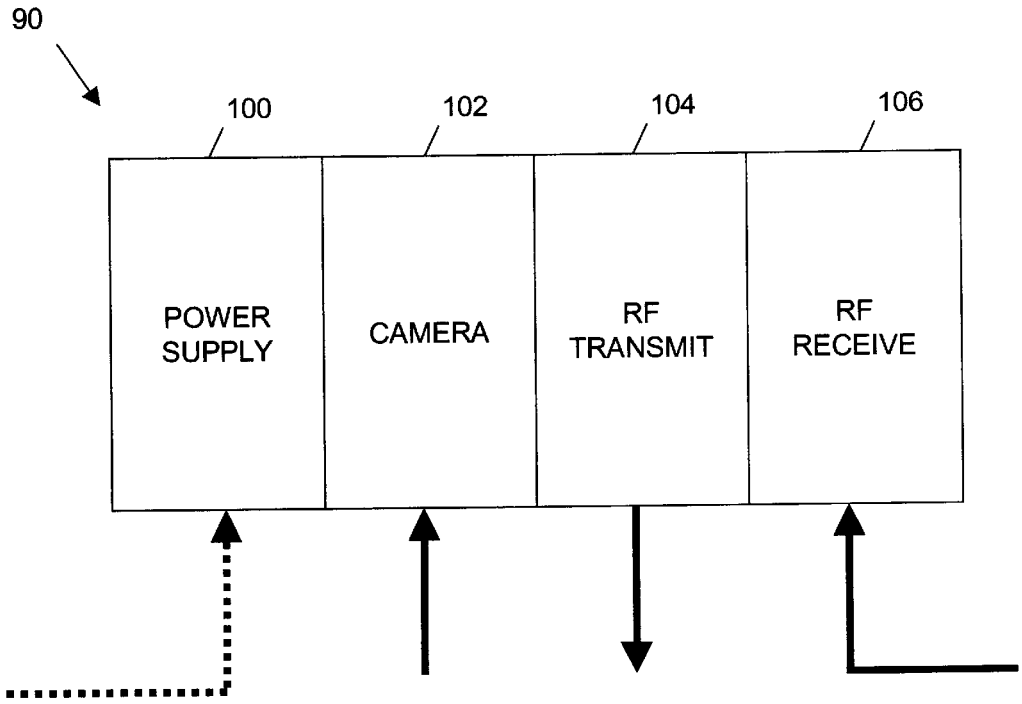
FIG. 13 is a detailed functional block diagram showing details of the information gathering device of FIG. 12.

In preferred embodiments of the invention, as shown in FIG. 13, the information gathering device 90 comprises a D.C. power supply 100, a camera 102, an RF transmitter 104, and an RF receiver 106. The power supply 100 can be constructed using any suitable constant voltage source, including a rechargeable battery or an AC/DC transformer. A voltage level of 12 Volts should be sufficient to power the information gathering device 90. The camera 102 preferably has low lumen capability and the ability to capture live video images or sequential still images at a selectable frame rate. The camera 102, moreover, should be small and unobtrusive. For video images, the camera 102 will typically be an analog device. For still images, the camera 102 can be implemented as a digital device. In that case, the camera will include a memory implemented using a conventional RAM (Random Access Memory) or flash memory chip (or plug-in card). A memory size of about 16 MB (MegaBytes), expandable to 256 MB, should be sufficient for this purpose. The RF transmitter 104 is adapted to transmit image information captured by the camera 102. If the camera 102 is an analog device, such as an analog video camera, the RF transmitter 104 will transmit analog RF signals. If the camera 102 is a digital device, such as a digital still camera, the RF transmitter 104 will transmit digital RF signals or analog RF signals following digital-to-analog conversion of the camera images.

It will be appreciated that there are a number of commercially available surveillance products that can be used to implement the power supply 100, the camera 102 and the RF transmitter 104. One such product is the Xcam2™ video camera kit available at the www.X10.com Internet website. This product integrates a color analog video camera that can transmit live color video (and audio) signals up to 100 feet, a microphone (for audio signal generation), and a 2.4 GHz. transmitter into a single device of relatively small size.

The RF receiver 106 can be implemented using the RF receiving circuit components of the previously-described receiver means 30 (see e.g., FIG. 10). It is tuned to receive RF transmissions from the signal transmitting means 20, and in particular, the predetermined signal sent by the signal transmitting means 20 in response to movement of the retractable wire affixing means 28.

The remote notification device 92 can be implemented in several ways according to preferred embodiments of the invention. In one embodiment, shown in FIG. 14A, the computer 94 is used. The remote notification device of this embodiment, designated by reference numeral 92A, is a unit that includes an RF receiver 112 and a suitable output 110 (e.g., a USB port, serial connector, or other suitable interface) for feeding information received from the information gathering device 90 to the computer 94. Power may be received from the computer 94 via a suitable power input (not shown), or the device 92A may include its own power supply 114. The latter may be a rechargeable battery or an AC/DC transformer. The RF receiver 112 operates at the frequency of the RF transmitter 104 in the information gathering device 90. It is adapted to receive and process either analog or digital transmissions, depending on the nature of the RF transmitter 104.

Figure 14A:
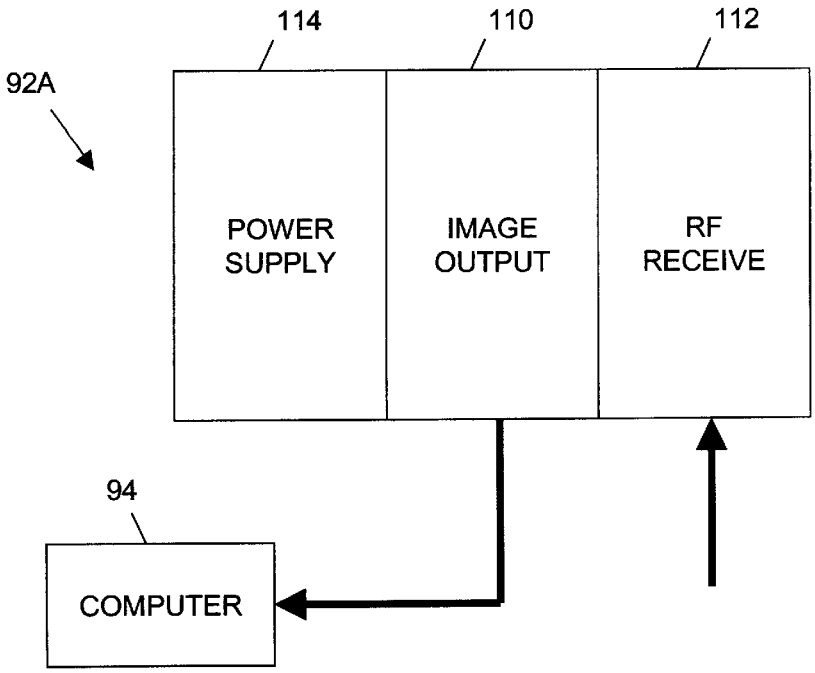
FIG. 14A is a detailed functional block diagram showing details of a first embodiment of the remote notification device of FIG. 12.

In the embodiment of FIG. 14A, the computer 94 includes a network interface (e.g., an analog or digital modem, an Ethernet card, or other suitable device) and appropriate control software. In particular, the software must be capable of establishing/maintaining a connection to the remote host 96 and forwarding information thereto that is received from the information gathering device 90. The XRay Vision Internet Kit™ available at the aforementioned www.X10.com Internet website is one product that can be used to implement the remote notification device 92A according to the instant embodiment. This product includes an integrated RF receiver and USB converter to capture and manage images received from the X10™ wireless video camera referred to above. Software that is provided with the product is adapted to operate on the computer 94 and forward the images received by the remote notification device 92A to any suitable remote network host, either in real time if the remote host is so equipped, or via e-mail.

Figure 14B:
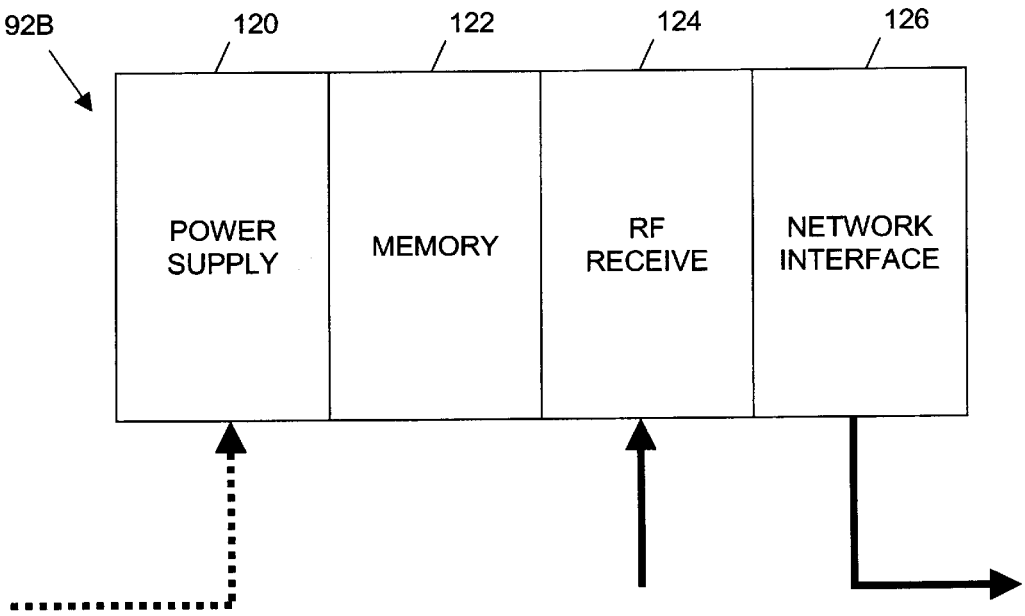
FIG. 14B is a detailed functional block diagram showing details of a second embodiment of the remote notification device of FIG. 12.

In a second embodiment of the remote notification device 92, shown in FIG. 14B, the device, referred to by reference numeral 92B, is a stand-alone unit that does not require the computer 94. It includes a D.C. power supply 120, a memory 122, an RF receiver 124, and a network interface 126. The power supply 120 can be constructed using any suitable constant voltage source, including a rechargeable battery or an AC/DC transformer. A voltage level of 12 Volts should be sufficient to power the remote notification device 92. The memory 122 can be implemented using a conventional RAM or flash memory chip (or plug-in card). A memory capacity of about 4 to 16 MB, expandable to 256 MB or more, should be sufficient for the remote notification device 92. The RF receiver 124 operates at the frequency of the RF transmitter 104 in the information gathering device 90. It is adapted to receive and process either analog or digital transmissions, depending on the nature of the RF transmitter 10. The network interface 126 can be implemented using a conventional analog modem, a digital modem (e.g., ISDN), or an Ethernet card, any of which are connected or connectable to a data network, such as the public Internet. A wireless interface such as a cellular transmitter/receiver adapted to communicate cellular digital packet data could also be used. The interface might alternatively comprise a Bluetooth or Home RF (e.g. Wi-Fi (IEEE 802.11b)) device that communicates over an air interface with another local device (e.g., a computer or cellular telephone) containing any of the foregoing network interface devices.

Figure 14C:
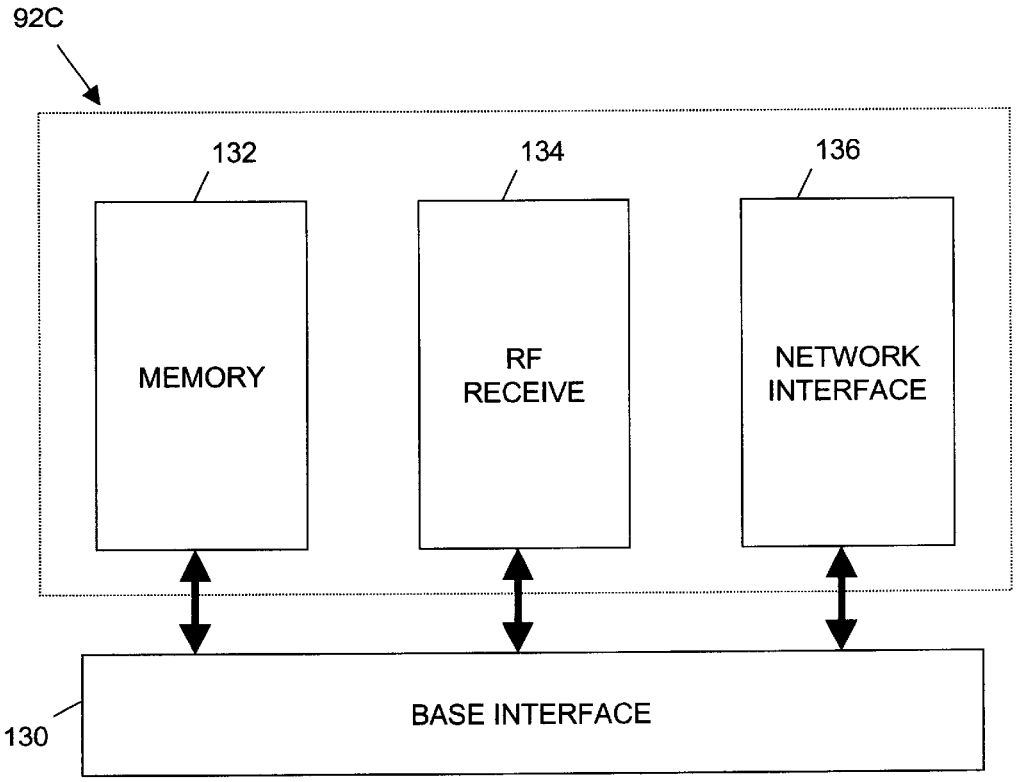
FIG. 14C is a detailed functional block diagram showing details of a third embodiment of the remote notification device of FIG. 12.

In a third embodiment of the remote notification device 92, shown in FIG. 14C, the device, referred to by reference numeral 92C, comprises various functional devices that plug in as modules to a suitable base interface 130. If the base interface 130 is a computer, the plug-in modules could be implemented as PC or PCMIA cards. Other base interfaces include the DVi family of set top devices from Motorola Corporation. In either case, the plug-in modules could include a memory module 132, an RF receiver module 134, and a network interface module 136. Power for these modules would be typically provided by the base interface 130. The memory module 132 can be implemented using a conventional RAM or flash memory chip (or plug-in card). A memory capacity of about 4 to 16 MB, expandable to 256 MB or more, should be sufficient for the remote notification device 92C. The RF receiver module 134 operates at the frequency of the RF transmitter 104 in the information gathering device 90. It is adapted to receive and process either analog or digital transmissions, depending on the nature of the RF transmitter 104. The network interface module 136 can be implemented using a conventional analog or digital modem, an Ethernet card, or any other suitable device.

Figure 15:
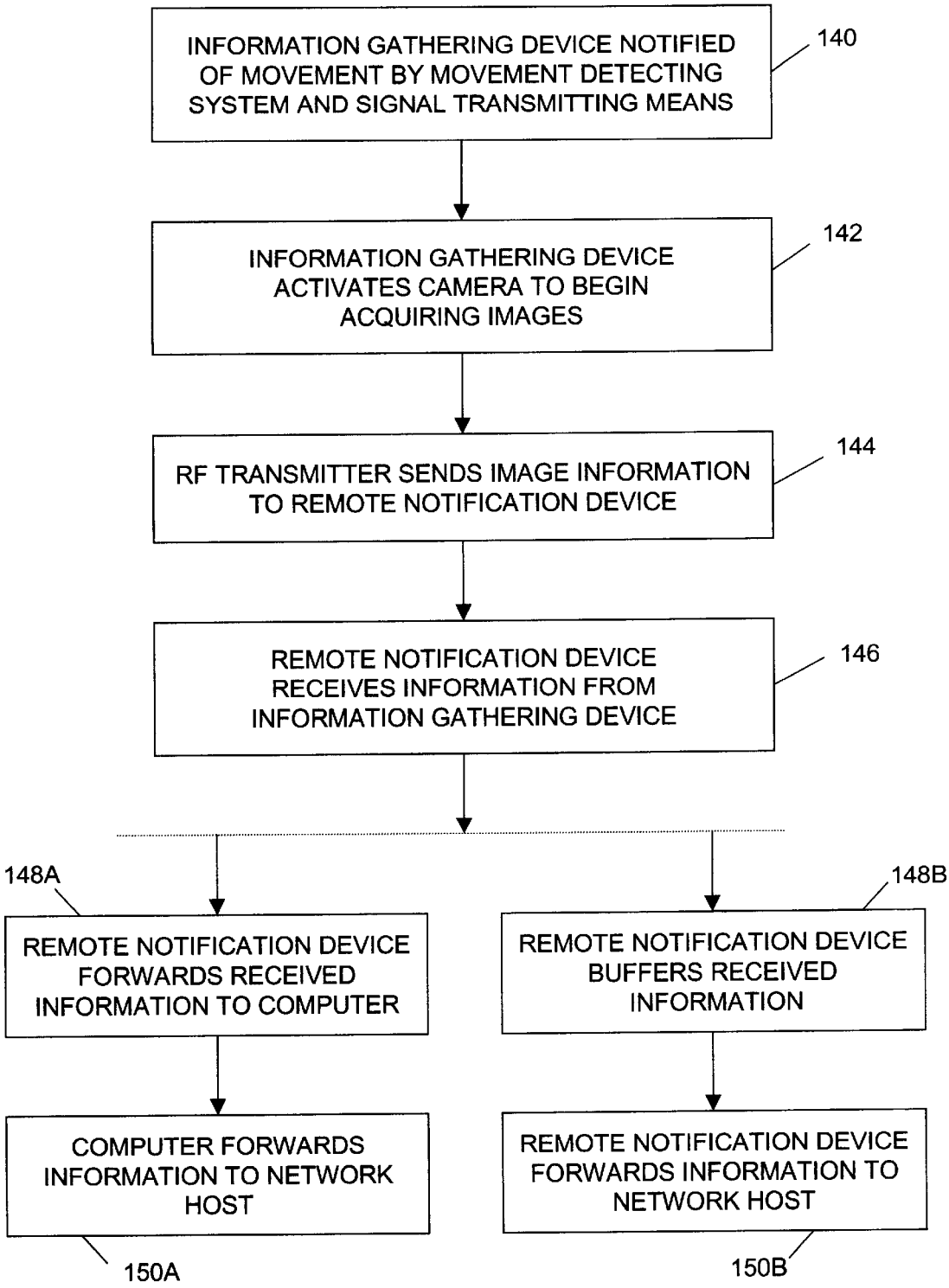
FIG. 15 is a flow diagram showing operational steps performed by the information gathering and remote notification devices of FIG. 12.

Referring now to FIG. 15, the operation of information gathering device 90 and the remote notification device 92 will now be described. In step 140, the information gathering device 90 is notified of a movement event by receiving (at the RF receiver 106) a predetermined signal from the movement detecting and signal transmitting means 20. The information gathering device then activates its camera 102 to begin acquiring pictures in step 142. The camera 102 is preferably aimed at the vicinity of the retractable wire affixing means 28, such that the cause of the movement will be viewable. In step 144, the RF transmitter 104 begins sending image information to the remote notification device 92. If the information gathering device also includes a microphone, the RF transmitter 104 will also send audio information to the remote notification device 92.

In step 146, the remote notification device 92 receives the information transmitted by the information gathering device at its RF receiver 106/112/124 (see FIGS. 14A, 14B, and 14C, respectively). If the remote notification device is implemented according to FIG. 14A, it forwards the received information to the computer 94 in step 148A. The computer 94 then establishes a network connection, as necessary, and forwards the information to the remote host 96 in step 150A. If the remote notification device is implemented according to FIG. 14B or 14C, it buffers the received information in its memory 122/132 in step 148B. In step 150B, the remote notification device establishes a network connection, as necessary, and forwards the information to the remote host 96.

The remote host 96 can be implemented as an Internet host that responds to the information received from the remote notification device 92 as either an information processing point or a store-and-retrieval point. For example, the host 96 might be a server at a security agency that displays the received information on a monitor for viewing by a security agent. Alternatively, the information could be forwarded, via email or the like, to the owner of the premises where the system 10 is located, or elsewhere. Still further, the host 96 might itself be an email server that receives the information from the remote notification device 92 as an attachment to an email addressed to the owner of the premises under surveillance, or elsewhere.

Turning now to FIGS. 16–20, an optional aspect of the invention will be described that allows object identification information to be provided locally and/or remotely to a designated location, such as a subscriber's forwarding telephone number, a law enforcement agency, or a security agency. In this way, when a subscriber's movement detecting and signal transmitting means 20 is triggered, a meaningful description of the object to which the device was attached can be provided.

Figure 16:
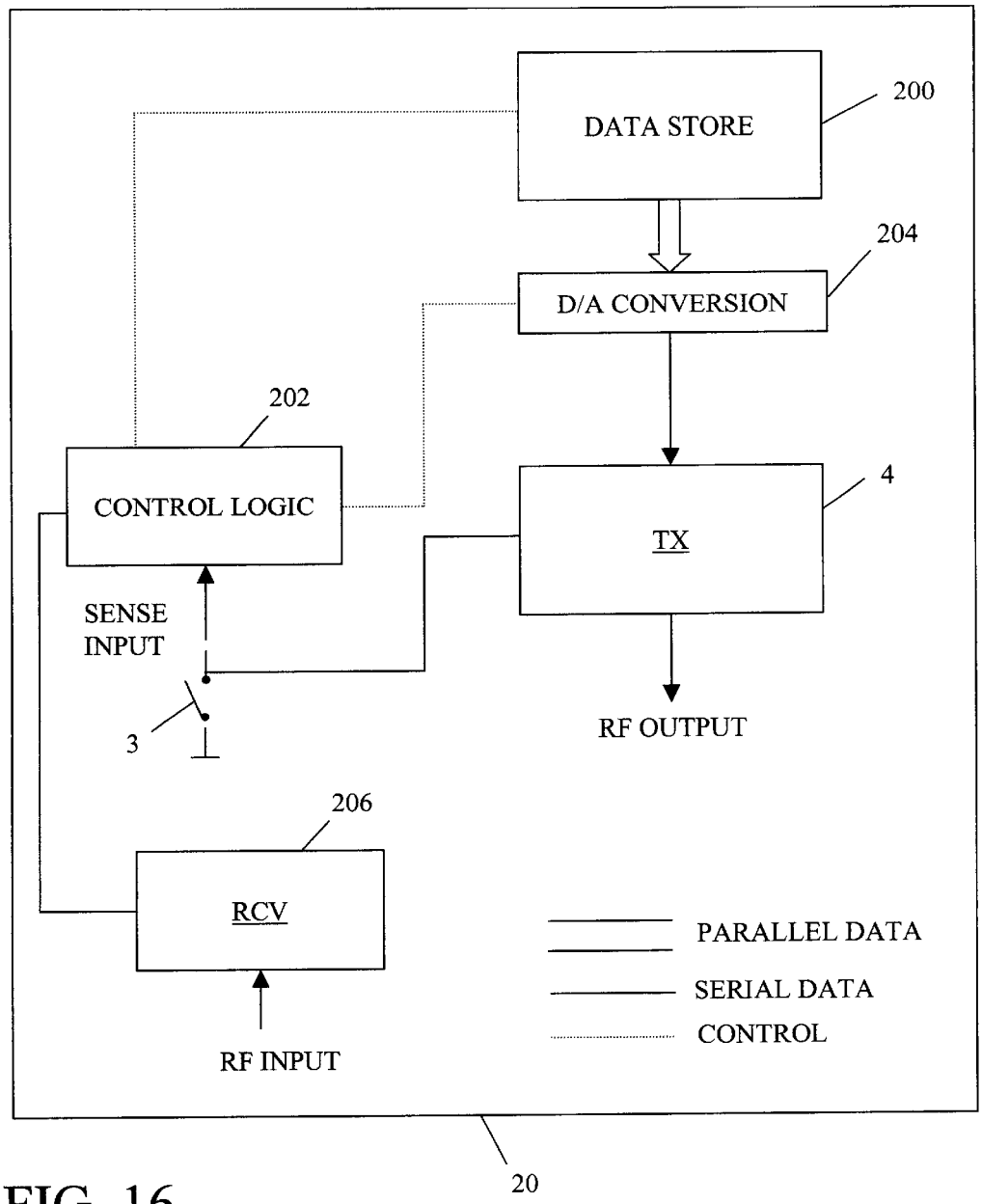
FIG. 16 is a detailed functional block diagram showing optional aspects of the motion sensing and transmitting means of the present invention.

In FIG. 16, the motion sensing and transmitting means 20 of FIG. 9 is shown with additional components that allow it to store a unique identifier, such as a digital code word, and then wirelessly transmit the identifier to the receiver means 30 (see FIG. 1) whenever the object whose movement is to be detected is displaced from a predetermined position. In the exemplary design of FIG. 16, the unique identifier is stored in a data store 200 of suitable size. By way of example only, the data store 200 can be implemented using a flash ROM or RAM memory chip (or plug-in card) whose size is based on the required size of the unique identifier. For example, if the unique identifier is a product serial number comprising "n" ASCII characters, the data store can be implemented as an "n×8" memory array, as an "n/2×16" memory array, as an "n/4×32" memory array, and so on. Note that the term "unique identifier" does not necessarily require that the identifier be unique relative all other motion sensing and transmitting means 20 owned by all subscribers. Rather, in view of certain programmability features described in more detail below, the unique identifier need only be unique with respect to the motion sensing and transmitting means 20 owned by one subscriber.

Closure of the switch 3 (as a result of displacement of the object whose movement is to be detected) activates the transmitter 4 and also provides a sense input to a control logic circuit 202. The latter can be implemented in fairly straightforward fashion as a data selector with clocking to facilitate selective (e.g., sequential) output from one or more array locations in the data store 200. Alternatively, to provide a more feature-rich design, the logic circuit 202 could be implemented as a programmable processor. In that event, the data store 200 will preferably contain the processor's control programming code in addition to the unique identifier. A programmable processor implementation of the logic circuit 202 would also facilitate the implementation of other useful functions in the motion sensing and transmitting means 20, such as the ability to control the device from the receiver means 30 or some other remote location. Thus, assuming a radio receiver 206 (see FIG. 16) is added to the motion sensing and transmitting means 20, or combined with the radio transmitter 4 as a transceiver, the control logic 202 could be remotely programmed via radio control to facilitate a variety of operations, such as polling the device to determine operating conditions, battery states or other useful information, and programming the device to set and/or reset its various operational characteristics.

When the control circuit 202 is activated upon closure of the switch 3, the unique identifier in the data store 200 is transferred to a D/A (Digital-to-Analog) converter 204 and converted to a corresponding analog signal. The analog signal is used to modulate the RF output of the transmitter 4 (see FIG. 9), such that the unique identifier is wirelessly transmitted to the receiver means 30 as an encoded RF signal. Alternatively, the unique identifier could be transmitted in digital form without D/A conversion.

Figure 17:
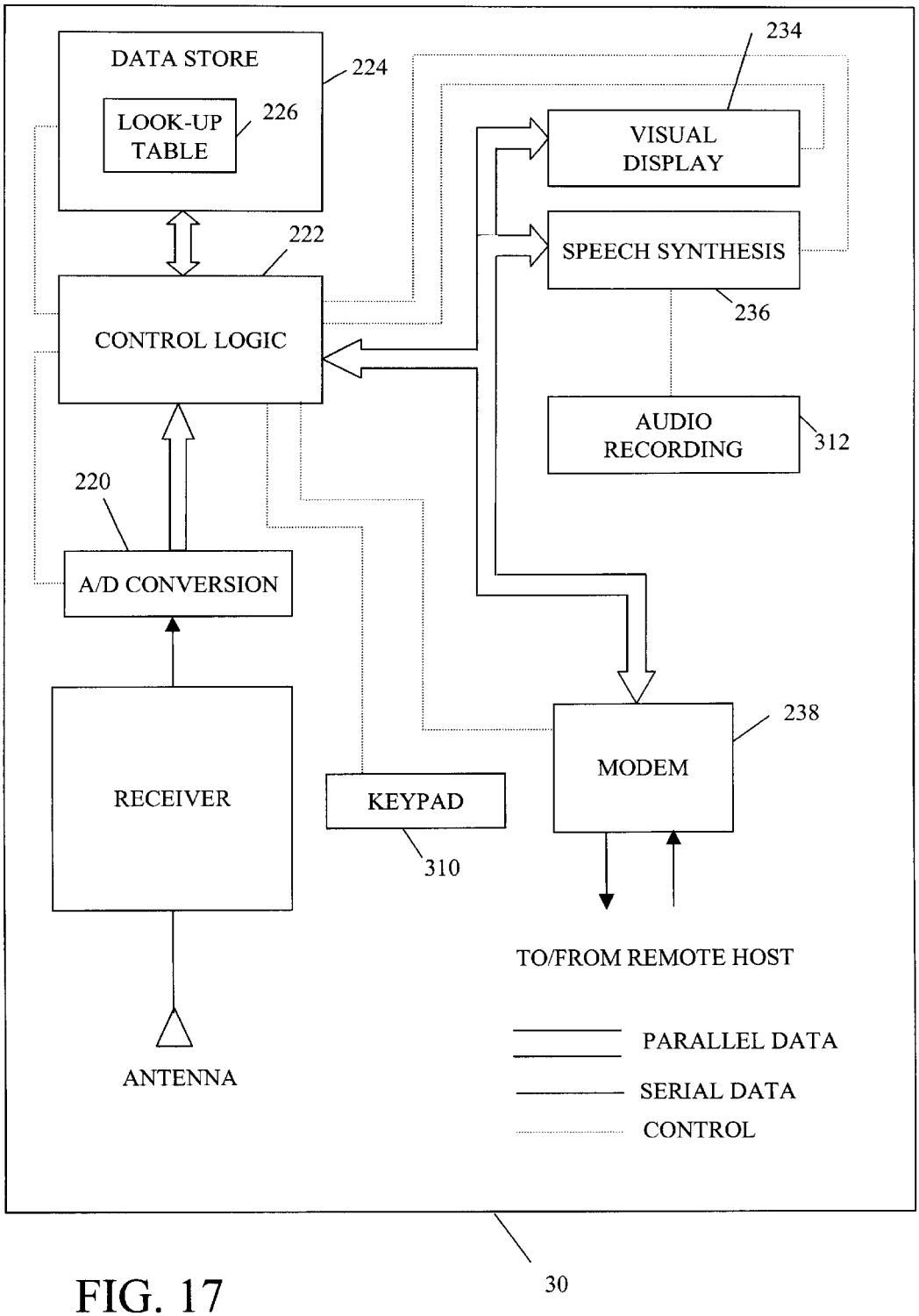
FIG. 17 is a detailed functional block diagram showing optional aspects of the receiver means of the present invention.

In FIG. 17, the receiver means 30 of FIG. 10 is shown with additional components that allow it to process the encoded RF signal received from the motion sensing and transmitting means 20 and convert it to digital form (as necessary) to recover the unique identifier. The unique identifier is then processed (either locally, remotely or both) for conversion to object identification information identifying the object to which the motion sensing and transmitting means 20 is attached. Regardless of where the unique identifier is converted, the object identification information can be output locally at the receiver means and/or it can be provided remotely to a forwarding telephone number designated by the subscriber, or to another location such as a law enforcement or security agency.

In the exemplary design of FIG. 17, the receiver means 30 includes the antenna and the receiver of FIG. 10. The receiver is tuned to the frequency of the transmitter 4 in the motion sensing and transmitting means 20. It demodulates the encoded RF signal. If the unique identifier is received in analog form, it is forwarded to an A/D (Analog-to-Digital) converter 220 for conversion to digital form. The unique identifier is then provided to a control logic circuit 222. The control logic circuit 222 is preferably implemented as a programmable processor that is associated with a related data store 224 that contains programming code for the control logic circuit. The data store 224 can be implemented using a conventional memory component, such as a flash ROM or RAM memory chip (or plug-in card) whose size is minimally based on the required size of the programming code.

Figure 18:
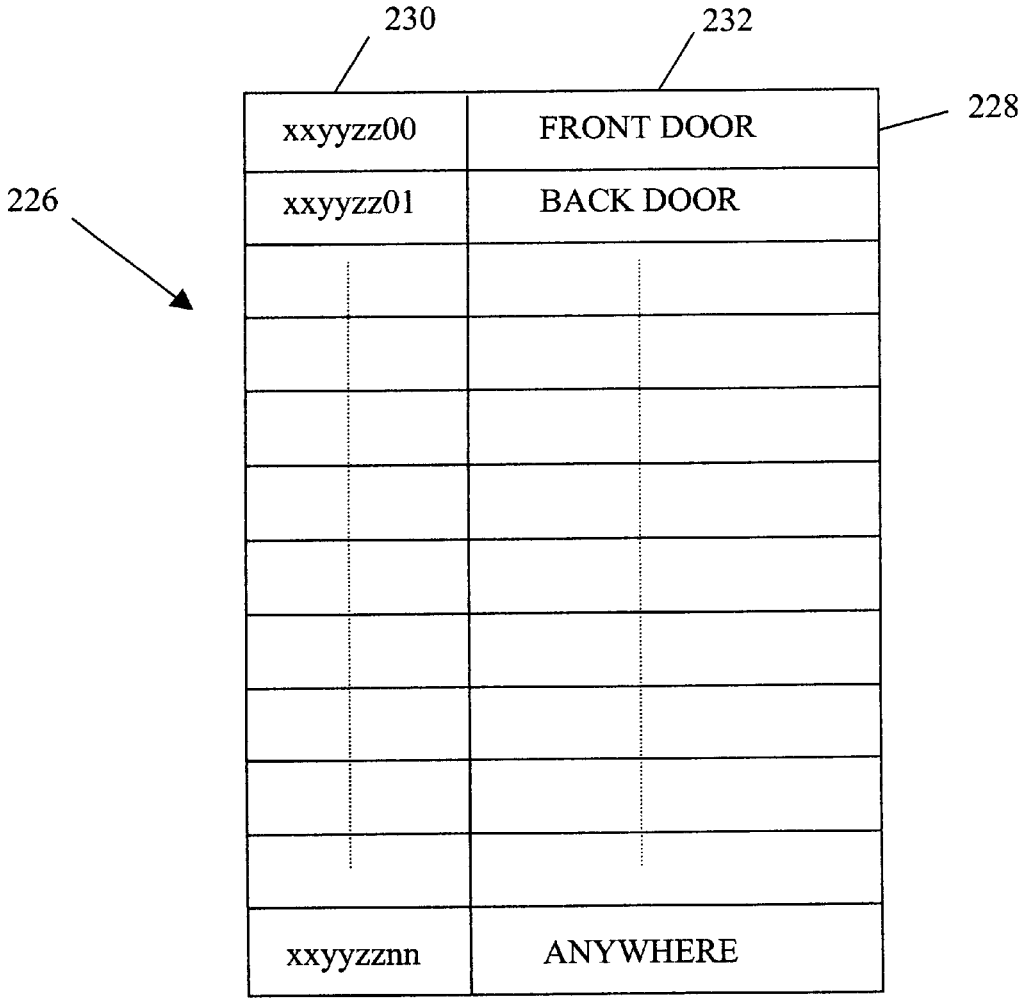
FIG. 18 is a diagrammatic representation of a unique identifier look-up table.

The memory used for the data store 224 may further contain an optional look-up table 226 if it is desired that the receiver means 30 convert the unique identifier locally into object identification information. An exemplary implementation of the look-up table 226 is shown in FIG. 18. This implementation features one or more row entries 228 for matching the unique identifier received from the motion sensing and transmitting means 20 with a descriptive word or phrase. Each entry 228 comprises a data set that contains a unique identifier field 230 and a descriptive word or phrase field 232.

By searching the unique identifier field 230 for an entry that matches the unique identifier received from the motion sensing and transmitting means 20, the control logic circuit 222 can rapidly correlate the unique identifier with a descriptive word or phrase that identifies the object to which the movement detecting and signal transmitting means 20 is attached. As shown in FIG. 17, the control logic circuit 222 can then output this information locally in visual form to a visual display device 234 (e.g., an LCD), or audibly to a speech synthesizer (e.g. wavetable) device 236, or both. This will permit a person who is physically present within visible or audible range of the receiver means 30 to promptly determine the location of the motion sensing and transmitting means 20 that set off the alarm system 10.

The control logic circuit 222 can also be implemented to forward the unique identifier received from the motion sensing and transmitting means 20 as part of an alarm alert to a remote security administration system (not shown in FIG. 17) so that an object identification look-up can be performed remotely. As described in more detail below, the security administration system can be programmed to respond to the alarm by sending an alert to a subscriber-designated contact location (e.g., a forwarding telephone number), advising that the alarm system 10 has been triggered and specifying the location of the motion sensing and transmitting means 20 that triggered the alert. Additionally, or in the alternative, the security administration system can download the object identification information to the receiver means 30 for output via the visual display device 234 or the speech synthesizer 236. This feature could be used in implementations where the receiver means 30 does not perform local conversion of the unique identifier to object identification information.

A modem 238 in the receiver means 30 can be used for transmittal of the unique identifier via a telephone line to a remote computer host implementing the security administration system. Alternatively, the receiver means 30 could be equipped with a data network interface for connection to the remote computer host via a computer data network, such as the global Internet. The connection could further include any of a cable interface, an Ethernet interface, a radio/cellular interface, etc. that physically interconnects the receiver means 30 to the remote computer host.

Figure 19:
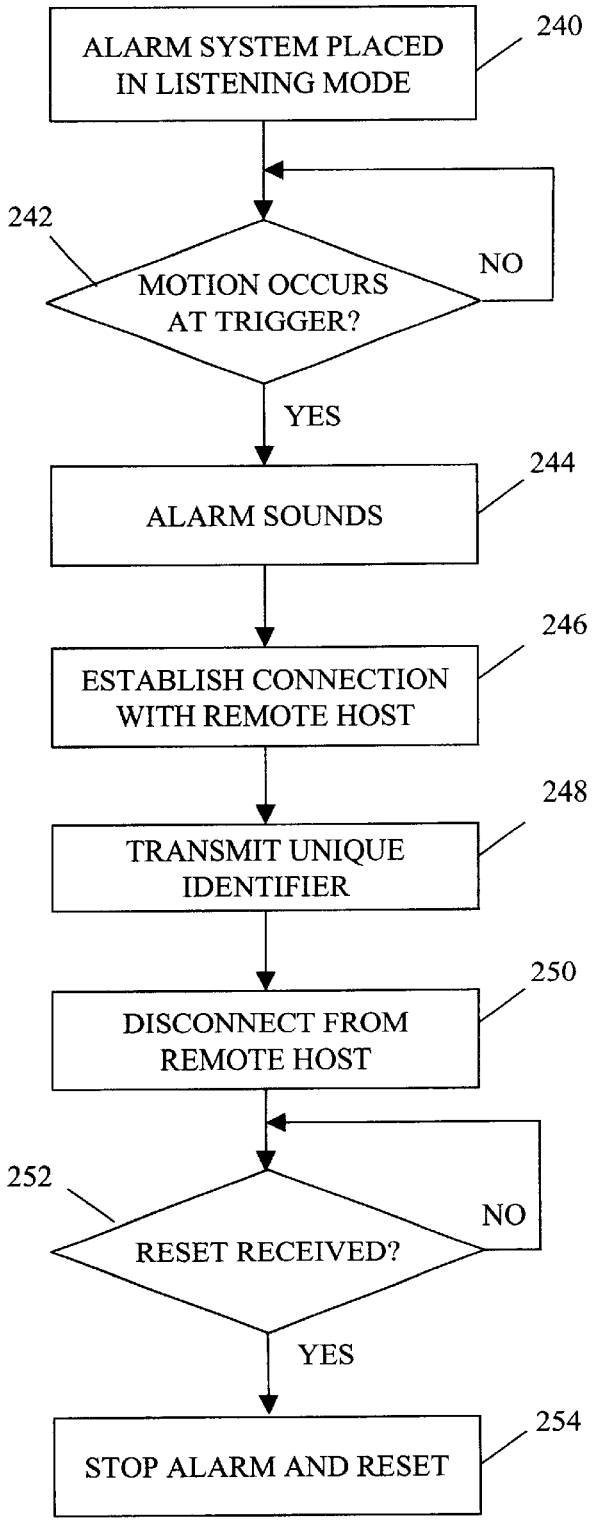
FIG. 19 is a flow diagram showing operation of the alarm system of the invention.

FIG. 19 is a flow diagram showing operational steps performed by the control logic circuit 222 of the receiver means 30 in an exemplary embodiment in which the unique identifier is transmitted to the security administration system for remote conversion to object identification information. Beginning in step 240, the control logic circuit 222 is placed in a listening mode to await input from one or more motion sensing and transmitting means 20 within RF transmission range. In step 242, the control logic circuit 222 waits for input from the one or more motion sensing and transmitting means 20. If such input is received, indicating that one of the motion sensing and transmitting means 20 has been disturbed, an audible alarm is sounded in step 244 via the circuitry of FIG. 10. In step 246, the modem 220 establishes a connection with the remote computer host. In step 248, the unique identifier is fed to the modem 220 and transmitted to the security administration system. A stored subscriber authentication code is preferably also sent (in advance of sending the unique identifier), so that the receiver means 30 can be identified and validated. The security administration system may then optionally return object identification information if the receiver means 30 is adapted to locally display such information. Otherwise, such information is not returned by the security administration system. In step 250, the modem 220 disconnects from the remote computer host. In step 252, the control logic circuit 222 waits for a reset signal, e.g., from the remote control unit 40 (see FIG. 1). When the reset signal is received, the audible alarm is shut off and the receiver means 30 is reset to standby mode in step 254.

Figure 20:
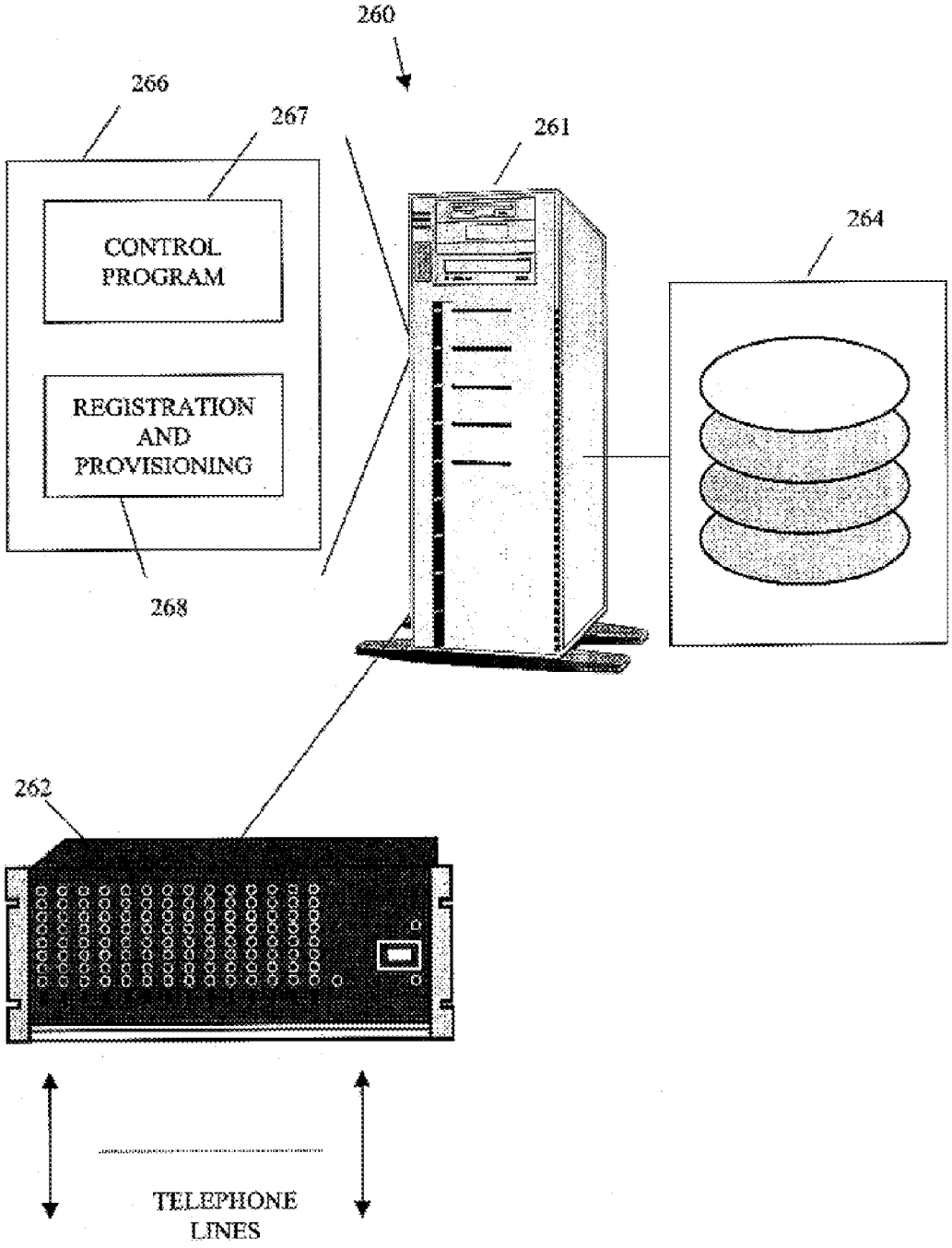
FIG. 20 is a functional block diagram showing optional aspects of a remote computer host of the present invention.

In FIG. 20, an exemplary security administration system 260 as described above is shown. The security administration system 260 includes a computer host 261 and a modem pool 262 containing plural modems that allow simultaneous connections with multiple alarm systems 10 associated with multiple subscribers. Although not shown, the security administration system 260 may also include a data network interface for communicating with multiple alarm systems 10 via a computer data network, such as the public Internet.

There is also connected to the computer host 261 a large capacity data storage resource 264 (such as a storage array, a storage network, etc.) that stores a subscription database containing subscriber information for multiple subscribers. The subscription information includes data sets that correlate the unique identifiers associated with each subscriber's motion sensing and transmitting means 20 with object identification information specified by the subscriber. The subscription information preferably further includes contact information for use in forwarding the object identification information.

The computer host 261 further includes a memory 266 that stores a security monitoring control program 267 for implementing the functionality required to receive and respond to incoming alarm alerts from the receiver means 30 of the multiple alarm systems 10. In addition, the memory 266 preferably further stores a subscriber registration and provisioning program 268 that allows subscribers to register for security service and provision user-specified object identification information to be associated with the unique identifiers associated with their motion sensing and transmitting means 20. Subscribers are also able to provision contact information that allows the security administration system 260 to contact them in the event of a security breach.

Figure 21:
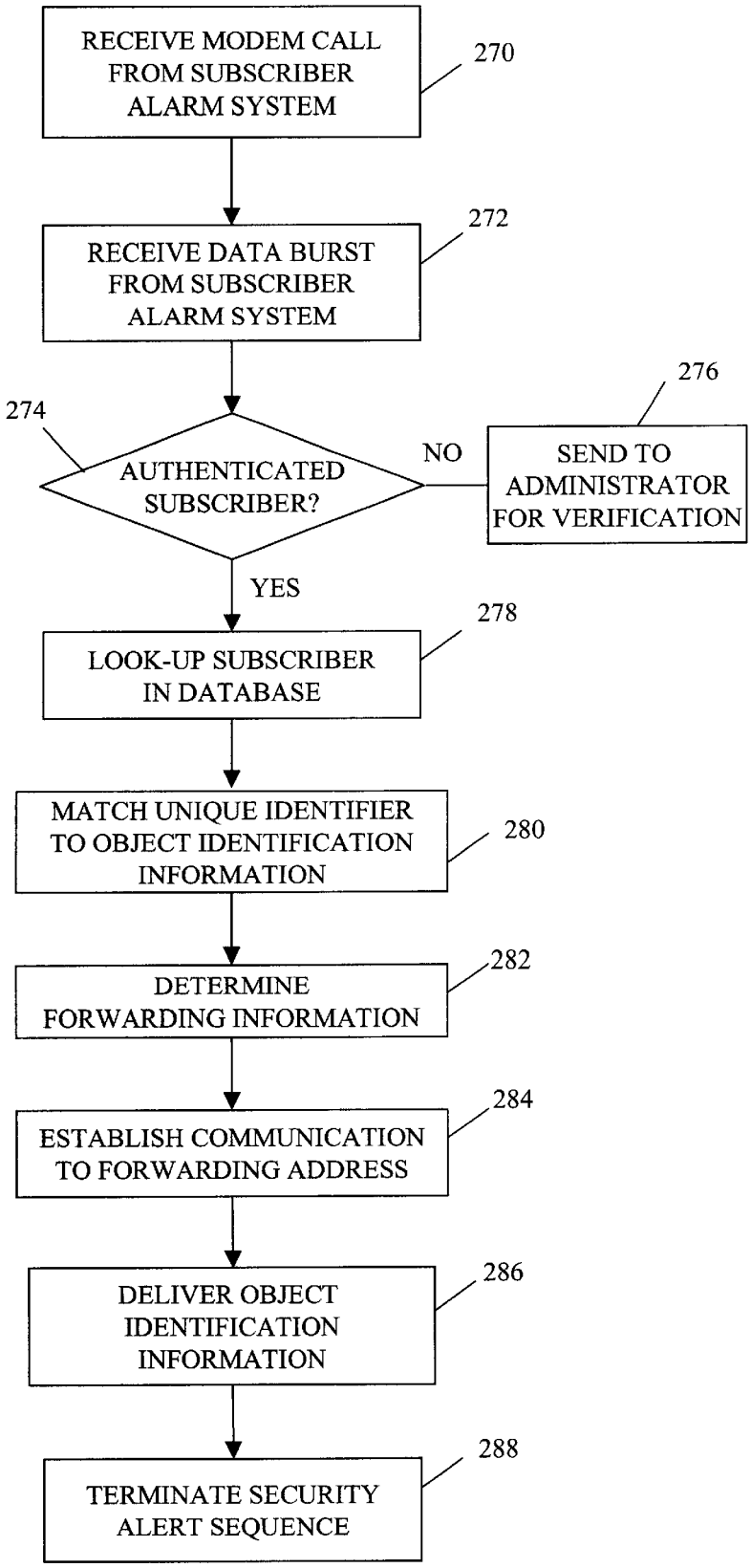
FIG. 21 is a flow diagram showing operation of the remote computer host of FIG. 20 during a subscriber registration and provisioning operation.

FIG. 21 is a flow diagram showing operation of an exemplary implementation of the security administration system 260 in response to an alarm alert sent from a receiver means 30. Beginning in step 270, the security administration system 260 receives a modem call from a subscriber's receiver means 30. In step 272, the computer host 261 receives a data burst from the receiver means 30. The data burst includes an authentication code identifying the receiver means 30 and a unique identifier corresponding to the movement detecting and signal transmitting means 20 that was triggered. In step 274, an authentication evaluation is made. If the receiver means 30 fails the authentication test, the authentication code can be sent to an administrator in step 276 for verification. If the receiver means 30 passes authentication, the computer host 261 retrieves the subscriber's subscription information in step 278 from the subscription database of the data storage resource 264. In step 280, the computer host 261 matches the unique identifier received in the data burst with the corresponding object identification information provisioned by the subscriber. In step 282, the computer host 261 obtains the subscriber's contact information. This could be a forwarding location associated with the subscriber, such as a voice telephone number, a facsimile telephone number, an email address, an IRC (Internet Relay Chat) address, or otherwise. The forwarding location could also be a law enforcement or security agency. Moreover, as stated above, the forwarding location could also be the receiver means 30 itself if local output of the object identification information is desired.

The computer host 261 then initiates a security alert sequence based on the subscriber's contact information. This sequence includes step 284 in which communication is established as necessary to the forwarding location and step 286 in which the object identification information corresponding to the activated movement detecting and signal transmitting means 20 is delivered. For example, if the forwarding location is a voice telephone number, the object identification information can be delivered as a live or synthesized voice message. For telephone, IRC, email or any other interactive media, the computer host 261 can prompt and hold for a response. For a telephone, the computer host 261 can prompt and hold for a response that represents the call recipient pressing various buttons on his or her telephone in order to connect to a designated emergency service agency or other entity. For example, the number "1" could be used to connect the call recipient to a police department, the number "2" could be used to connect the call recipient to a fire department, and the number "3" could be used to place a custom call. Some other number, such as the number "4," could be used to reset the alarm via the computer host 261.

If the forwarding location is a telephone or facsimile number, the object identification information can be transmitted via the public switched telephone network to a remote telephone or facsimile machine. If the forwarding location is an email or IRC address, the object identification information can be transmitted via a data network for delivery to a remote computer host. If the forwarding location is the receiver means 30, the object identification information can be transmitted via the modem pool 262 to the receiver means.

Following delivery of the object identification information, the remote computer host 261 terminates the security alert sequence in step 288. This step preferably includes logging the date and time of the security alert into the subscriber's account records, along with the object identification information. The logging operation can be used to create a security record and also for billing purposes.

As a result of the security alert sent by the security administration system 260, the subscriber will be provided with very specific information about the nature of the security breach. In particular, because the object identification information is provisioned by the subscriber, it can be personalized in a way that allows the subscriber to gauge their response to the security alert according to the information provided. For example, a young mother on a warm summer day may wish to attach one movement detecting and signal transmitting means 20 to the baby's crib during nap time, and another movement detecting and signal transmitting means 20 to a partially open window in the baby's room. Upon receipt of the security alert, the mother will know from the object identification information that the alert is either the result of the baby waking up and jostling the crib or a potentially serious security breach due to an intruder attempting to raise the baby's window.

Figure 22:
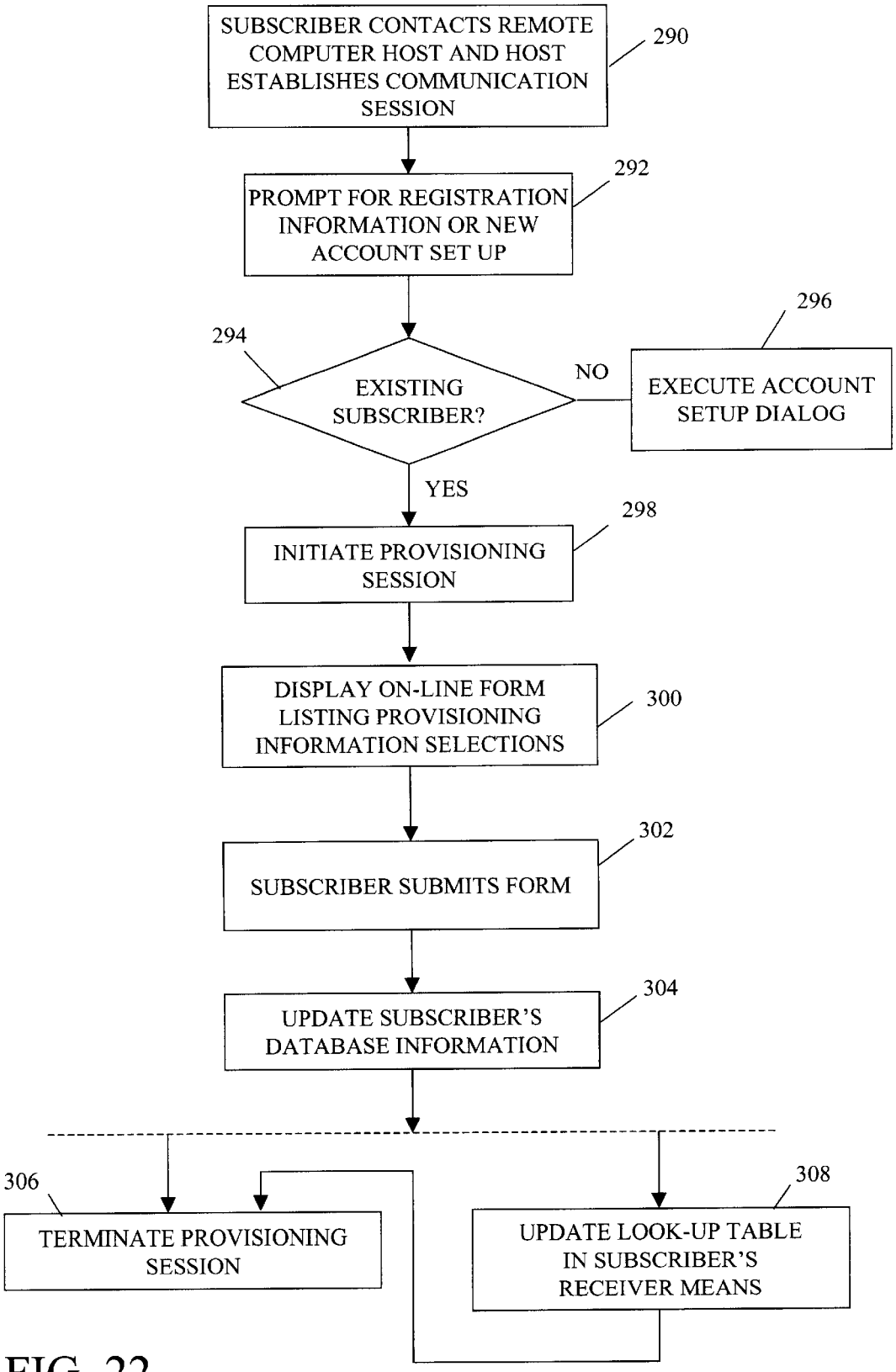
FIG. 22 is a flow diagram showing operation of the remote computer host of FIG. 20 during a security monitoring and response operation.

As will now be described with reference to the flow diagram of FIG. 22, it is very simple for a subscriber to provision each of their movement detecting and signal transmitting means 20 as these devices are attached to different objects. A network-attached computing device and a few moments of time to fill in an online form are all that is required. In step 290 of the provisioning process, the subscriber initiates contact with the computer host 261 and the latter establishes a communication session. In step 292, the computer host 260 prompts the subscriber for registration information (e.g., user name and password) if they have an existing account, or to set up a new account if the subscriber is not yet registered. If, in step 294, the subscriber indicates that they need to set up a new account, the computer host 261 engages the subscriber in an account setup dialog in step 296. This will establish a record of such information as the subscriber's name, billing address, login name, password, and an authentication identifier associated with the subscriber's receiver means 30. The subscriber will preferably also be requested to accept a subscription agreement. The computer host 261 will then create one or more account records in the subscriber database of the data storage resource 264, and if necessary, reserve storage space for the subscriber's provisioning information.

Following registration in step 296, or if the subscriber previously provided a registration number in step 292, the computer host 261 initiates a provisioning session in step 298. The provisioning session can be implemented in a variety of ways, but preferably involves the subscriber filling in fields in an on-line graphical form. Thus, in step 300, the computer host 260 presents the subscriber with a web page or the like containing a listing of one or more movement detecting and signal transmitting means 20 that can be provisioned. Each line of the listing will include a field specifying the unique identifier associated with the movement detecting and signal transmitting means 20, and a field containing the device's object identification information. When the subscriber first registers for service, the listing will be blank. For registered subscribers who have previously provisioned their movement detecting and signal transmitting means 20, the listing will show the subscriber's current provisioning information. The subscriber then updates the listing as to suit their current needs.

In step 302, the subscriber signifies that they have finished updating their provisioning information by submitting the online form. The computer host 261 then implements a CGI script or the like to process the form information in step 304 and update the subscriber's database information. Thereafter, the computer host 261 can terminate the provisioning session in step 306. Alternatively, an optional step 308 can first be performed in which the computer host 261 initiates a communication session with the subscriber's receiver means 30. The purpose of this session is to download the subscriber's provisioning information to the look-up table 226 in the receiver means 30 so that local conversion of unique identifiers to object identification information can be performed.

It will be appreciated that step 308 could be eliminated in implementations of the alarm system 10 where the receiver means 30 is configured to allow the subscriber to provision the look-up table 226 by hand. In particular, the receiver means 30 could be provided with a data entry interface, such as a keypad 310 and the visual display device 234, that allows the subscriber to program object identification information into the look-up table 226 (see FIG. 17) via the control logic 222. The receiver means 30 could also be provided with an audio recording system 312 that allows the subscriber to record object identification information as a series of audio messages that are each associated with a unique identifier in the look-up table 226.

Having now described various security functions of the alarm system set forth in the various embodiments above, it is important to note that the alarm system could be adapted for additional purposes, such as industrial process monitoring and measurements. This functionality could be provided by modifying the movement detecting and signal transmitting means 20 so that it produces an output indicating a distance that the retractable wire means 22 moves relative to the movement detecting and signal transmitting means 20 once the device has been set (see FIG. 1). This measurement feature could be for such functions as industrial tank expansion measurement, and the like. The measurement feature could be readily implemented with relatively minimal modification of the movement detecting and signal transmitting means 20. For example, the field sensor 56 and the closing contact 3 of FIGS. 7–9 could be implemented as a reed switch that will open and close as the magnets 54 pass by. Either the control logic 202 of the movement detecting and signal transmitting means 20 or the control logic 222 of the receiver means 30 can be programmed to count the number of pulses represented by each magnet 54 passing by the field sensor 56. Each pulse would be associated with a distance that the retractable wire means 22 moves relative to the movement detecting and signal transmitting means 20. The total number of pulses would thus correspond to the total distance moved. The distance could be reset to zero when the movement detecting and signal transmitting means 20 is set, following which distance monitoring would begin. Another implementation option would be to use optical counting by installing an optical source/detector pair in the movement detecting and signal transmitting means 20 and an optical signal modulator. The optical signal modulator could be an optical medium that is encoded with alternating light/dark bars, bar codes, etc. and which moves relative to the source/detector pair in response to motion of the retractable wire means 22, so as to thereby modulate the optical signal. The components used in a computer mouse pointing device represent one optical technology that could be used. The measurement information can be output locally by the receiver means 30 in audible or visual form, or it can be sent to a remote location using any of the communication modalities discussed above, including telephone, network, cable, radio/cellular communication, etc. Once the receiver means 30 outputs its message to the remote location, the remote location can respond to the message in various ways, including (1) messaging response instructions back to the receiver means 30 for forwarding to the signaling movement detecting and signal transmitting means 20 or any of its counterparts, (2) forwarding a customized message to a designated forwarding location, (3) taking any other appropriate action.

It should further be noted that a process measuring implementation of the invention may require consideration of environmental factors that lead to a change in the materials used to construct the various components of the alarm system. For example, it may be desirable to water-proof the movement detecting and signal transmitting means 20 for outdoor use. Similarly, will be understood that the retractable wire means 22 can be made from a variety of materials, including thread or string, synthetic line (e.g. fishing line), or more durable materials such as steel, tungsten, or the like for high heat use.

While the invention has been described in conjunction with various embodiments, they are illustrative only. Accordingly, many alternatives, modifications and variations will be apparent to persons skilled in the art in light of the foregoing detailed description. The foregoing description is intended to embrace all such alternatives and variations falling with the spirit and broad scope of the appended claims and their equivalents.

What is claimed is:

1. A portable security alarm system for detecting the movement of an object and providing information relative to said movement, said system comprising a motion sensor adapted to detect movement of an object and provide an indication of said movement including a unique identifier associated with said sensor, a transmitter associated with said sensor and adapted to wirelessly transmit a predetermined signal containing said indication, and a local receiver at or near the site of the object adapted to receive said predetermined signal, to process said unique identifier for local or remote conversion to associated object identification information that identifies said object, and to visually or audibly output said object identification information.

2. The system of claim 1 wherein said sensor is adapted for removable attachment to said object.

3. The system of claim 1 wherein said sensor is adapted to store said unique identifier.

4. The system of claim 1 wherein said object identification information is a word or a phrase.

5. The system of claim 4 wherein said receiver is adapted to deliver said unique identifier to a local control logic circuit for local conversion to said object identification information.

6. The system of claim 5 wherein said receiver includes a data store containing a look-up table adapted to store a data set that matches said unique identifier with said object identification information.

7. The system of claim 1 wherein said receiver is adapted to forward said unique identifier to a remote security administration system for remote conversion to said object identification information.

8. The system of claim 7 wherein said receiver is adapted to receive said object identification information from said security administration system following said remote conversion.

9. The system of claim 1 wherein said receiver is adapted to visually output said object identification information.

10. The system of claim 1 wherein said receiver is adapted to audibly output said object identification information.

11. The system of claim 1 in association with a remote security administration system comprising a computer host, a communication interface, and a data storage resource.

12. A system in accordance with claim 11 wherein said data storage resource stores a subscriber database containing provisioned object identification information in association with provisioned unique identifier information for subscribers using said portable security alarm system.

13. The system of claim 1 wherein said receiver includes programming means for receiving and storing said object identification information in association with said unique identifiers at said receiver to provide a local programming function.

14. The system of claim 13 wherein said programming means include one or more of means for receiving and recording a text input and means for receiving and recording an audio input, said inputs representing said object identification information.

15. A portable security alarm system for detecting the movement of an object and providing information relative to said movement, said system comprising a motion sensor adapted to detect movement of an object and provide an indication of said movement including a unique identifier associated with said sensor, a transmitter associated with said sensor and adapted to wirelessly transmit a predetermined signal containing said indication, and a receiver adapted to receive said predetermined signal and to process said unique identifier for local or remote conversion to associated object identification information that identifies said object;

a remote security administration system comprising a computer host, a communication interface, and a data storage resource;

said data storage resource storing a subscriber database containing provisioned object identification information in association with provisioned unique identifier information for subscribers using said portable security alarm system; and wherein said computer host is programmed to execute a subscriber registration function allowing said subscribers to remotely subscribe for security service.

16. The system of claim 15 wherein said computer host is programmed to execute a subscriber provisioning function allowing subscribers to remotely provision one or more of said unique identifiers with association with one or more instance of said object identification information.

17. The system of claim 16 wherein said provisioning function includes downloading to said receiver one or more data sets that each associates one of said unique identifiers with an instance of said object identification information.

18. The system of claim 17 wherein said provisioning function includes presenting to said subscribers an on-line form allowing said subscribers to specify the content of said data sets.

19. A portable security alarm system for detecting the movement of an object and providing information relative to said movement, said system comprising a motion sensor adapted to detect movement of an object and provide an indication of said movement including a unique identifier associated with said sensor, a transmitter associated with said sensor and adapted to wirelessly transmit a predetermined signal containing said indication, and a receiver adapted to receive said predetermined signal and to process said unique identifier for local or remote conversion to associated object identification information that identifies said object;

a remote security administration system comprising a computer host, a communication interface, and a data storage resource; and wherein said computer host is programmed to execute a security alert sequence automatically without human intervention in which said computer host contacts and provides security information to a location designated by a subscriber using said portable security alarm system in response to an alarm activation.

20. The system of claim 19 wherein said location includes an interactive response medium.

21. The system of claim 20 wherein said security alert sequence includes a prompt and hold sequence in which said computer host prompts and holds for one or more responses to said security alert via said interactive response medium.

22. The system of claim 21 wherein said one or more responses include establishing communication between said location and a security agency or other entity.

23. The system of claim 21 wherein said one or more responses include an alarm reset request.

24. A portable security alarm system for detecting the movement of an object and providing information relative to said movement, said system comprising a motion sensor adapted to detect movement of an object and provide an indication of said movement including a unique identifier associated with said sensor, a transmitter associated with said sensor and adapted to wirelessly transmit a predetermined signal containing said indication, and a receiver adapted to receive said predetermined signal and to process said unique identifier for local or remote conversion to associated object identification information that identifies said object; and wherein said motion sensor includes RF receiving means for receiving wireless transmissions from said receiver and control means responsive to said wireless transmissions for implementing control functions and providing operational information wirelessly to said receiver.

25. A portable security alarm system for detecting the movement of an object and providing information relative to said movement, said system comprising a motion sensor adapted to detect movement of an object and provide an indication of said movement including a unique identifier associated with said sensor, a transmitter associated with said sensor and adapted to wirelessly transmit a predetermined signal containing said indication, and a receiver adapted to receive said predetermined signal and to process said unique identifier for local or remote conversion to associated object identification information that identifies said object; and wherein said motion sensor is adapted to provide measurement information to said receiver representing a distance moved by said object, and wherein said receiver is adapted to process or forward said measurement information as part of a process monitoring function.

26. A security network comprising a security administration system and plural portable security alarm systems, said security administration system comprising a computer host programmed to provide subscriber registration and provisioning functions, a communication interface, and a data storage resource containing provisioned object identification information in association with provisioned unique identifier information for subscribers using said portable security alarm systems, said portable security alarm systems each comprising plural motion sensors adapted to detect movement of associated objects and provide an indication of said movement including a unique identifier associated with each sensor, a transmitter associated with each sensor and adapted to wirelessly transmit a predetermined signal containing said indication, and a receiver adapted to receive said predetermined signals from said sensors and to forward said unique identifiers for conversion to associated object identification information that identifies said objects.

27. The system of claim 26 wherein each of said unique identifiers is unique relative to all other motion sensors in said security network.

28. The system of claim 26 wherein each of said unique identifiers is unique relative to all other motion sensors in the same portable security alarm system.

29. A method for providing portable security alarm service to a plurality of subscribers, each subscriber having a portable security alarm system comprising plural motion sensors adapted to detect movement of associated objects and provide an indication of said movement including a unique identifier associated with each sensor, a transmitter associated with each sensor and adapted to wirelessly transmit a predetermined signal containing said indication, and a receiver adapted to receive said predetermined signals from said sensors and to forward said unique identifiers for conversion to associated object identification information that identifies said objects, said method comprising the steps of establishing a communication dialog with a subscriber, requesting the subscriber to enter authentication information if the subscriber is registered for security service or to enter a registration dialog if the subscriber is not registered for security service, requesting the subscriber to establish data sets associating unique identifiers of one of said portable security alarm systems with corresponding object identification information, and terminating said communication dialog.

30. A portable security alarm system for detecting the movement of an object and providing information relative to said movement, said system comprising a motion sensor adapted to detect movement of an object and provide an indication of said movement including a unique identifier associated with said sensor, a transmitter associated with said sensor and adapted to wirelessly transmit a predetermined signal containing said indication, and a local receiver at or near the site of the object, said receiver being adapted to receive said predetermined signal, to process said unique identifier for local or remote conversion to associated object identification information that identifies said object, and to visually or audibly output said object identification information;

a remote security administration system in two way communication with said receiver, said remote security administration system comprising a computer host, a communication interface, and a data storage resource; and wherein said computer host is programmed to receive security or other information from said receiver and to send security or other information to said receiver for visual or audible output therefrom.

* * * * *